US011542933B2

(12) United States Patent
Kuntz et al.

(10) Patent No.: US 11,542,933 B2
(45) Date of Patent: Jan. 3, 2023

(54) SOUND REDUCTION DEVICE FOR ROCKING PISTON PUMPS AND COMPRESSORS

(71) Applicant: Gast Manufacturing, Inc., Benton Harbor, MI (US)

(72) Inventors: Bryan Kuntz, Niles, MI (US); Jeremy Snyder, South Bend, IN (US)

(73) Assignee: Gast Manufacturing, Inc., Benton Harbor, MI (US)

( * ) Notice: Subject to any disclaimer, the term of this patent is extended or adjusted under 35 U.S.C. 154(b) by 0 days.

(21) Appl. No.: 16/861,318

(22) Filed: Apr. 29, 2020

(65) Prior Publication Data

US 2020/0340468 A1 Oct. 29, 2020

Related U.S. Application Data

(60) Provisional application No. 62/840,107, filed on Apr. 29, 2019.

(51) Int. Cl.

| | |
|---|---|
| ***F04B 39/00*** | (2006.01) |
| ***F04B 53/00*** | (2006.01) |
| ***F04B 39/12*** | (2006.01) |

(52) U.S. Cl.

CPC ..... *F04B 39/0027* (2013.01); *F04B 39/0061* (2013.01); *F04B 39/12* (2013.01); *F04B 53/001* (2013.01)

(58) Field of Classification Search

CPC ..... Y10S 181/403; F04B 39/0061; F04B 39/0027; F04B 39/005; F04B 39/12; F04B 53/001

See application file for complete search history.

(56) References Cited

U.S. PATENT DOCUMENTS

| | | | | |
|---|---|---|---|---|
| 3,504,762 | A | 4/1970 | Valbjorn | |
| 4,370,104 | A * | 1/1983 | Nelson | F04B 39/0027 181/403 |
| 5,260,524 | A * | 11/1993 | Schroeder | F04B 39/0055 181/229 |
| 5,443,371 | A * | 8/1995 | Calciolari | F04B 39/0027 417/312 |
| 6,007,307 | A | 12/1999 | Sonoda | |
| 6,312,232 | B1 * | 11/2001 | Mori | F04B 39/0088 417/297 |

(Continued)

FOREIGN PATENT DOCUMENTS

| | | |
|---|---|---|
| CN | 104612941 A | 5/2015 |
| EP | 2570668 A3 | 3/2013 |

OTHER PUBLICATIONS

International Search Report from corresponding International Application No. PCT/US2020/030390, dated Aug. 7, 2020, 12 pages.

*Primary Examiner* — Dominick L Plakkoottam
(74) *Attorney, Agent, or Firm* — Tucker Ellis LLP; Heather M. Barnes; Michael G. Craig

(57) ABSTRACT

A rocking piston vacuum pump or compressor may have a sound attenuation assembly. The sound attenuation assembly may comprise a sound attenuation chamber. The chamber may have a first silencer disposed therein with sound dampening foam disposed therein. A second silencer may be disposed in series relative to the first silencer and may be disposed externally of the sound attenuation chamber.

15 Claims, 22 Drawing Sheets

(56) References Cited

U.S. PATENT DOCUMENTS 6,386,846 B1 * 5/2002 Murase ..... F04B 27/1036 181/403
6,702,880 B2 * 3/2004 Roberts ..... B01D 46/0023 181/231
6,840,746 B2 * 1/2005 Marshall ..... F04B 39/005 181/233
6,935,848 B2 * 8/2005 Marshal ..... F04B 39/0061 181/403
7,210,912 B2 * 5/2007 Tomell ..... F04B 39/0055 181/403
7,415,748 B1 * 8/2008 Guhr ..... E01H 1/0836 15/340.1
7,878,299 B2 * 2/2011 Geyer, III ..... F01N 1/082 181/243
9,863,412 B2 1/2018 Blackburn
2003/0234137 A1 * 12/2003 Buckner ..... F02M 35/14 181/231
2004/0009077 A1 * 1/2004 Seo ..... F04B 39/0061 417/312
2004/0175280 A1 * 9/2004 Seo ..... F04B 39/0072 417/312
2005/0023077 A1 2/2005 Sishtla
2006/0251527 A1 11/2006 Wester
2007/0154331 A1 * 7/2007 Tomell ..... F04B 39/0055 417/312
2010/0310389 A1 * 12/2010 Alvarenga ..... F04B 39/0055 417/312
2014/0147300 A1 * 5/2014 Blackburn ..... F04C 29/124 417/312
2014/0161640 A1 6/2014 Geue et al.
2015/0176580 A1 * 6/2015 Lee ..... F04B 39/1073 417/312
2018/0291890 A1 * 10/2018 Suppiger ..... F04B 53/14
2018/0347555 A1 * 12/2018 De Bortoli ..... F04B 39/0072
2019/0054635 A1 * 2/2019 Cho ..... B25J 15/0675

* cited by examiner

SOUND REDUCTION DEVICE FOR ROCKING PISTON PUMPS AND COMPRESSORS

RELATED APPLICATION DATA

This application claims benefit of U.S. Provisional Application No. 62/840,107 filed Apr. 29, 2019, of which is incorporated herein by reference.

BACKGROUND

Sound attenuation and vibration reduction are desired for rocking piston vacuum pumps and compressors. In medical and dental applications, multiple pieces of equipment may be in the same proximate location. As multiple pieces of equipment are used, the decibel level may increase. After reaching a certain decibel level, sound in a room may become distracting. Discussion between a health care provider and patient difficult. Further, the noise may cause feelings of uneasiness if a patient is anxious. As such, reducing noise produced by rocking piston vacuum pumps and rocking pistons in medical and dental applications is desired.

SUMMARY

This Summary is provided to introduce a selection of concepts in a simplified form that are further described below in the Detailed Description. This Summary is not intended to identify key factors or essential features of the claimed subject matter, nor is it intended to be used to limit the scope of the claimed subject matter.

A rocking piston vacuum pump or compressor may have a sound attenuation chamber. The chamber may have a first silencer disposed therein. A second silencer may be disposed in series relative to the first silencer and may be disposed externally of the sound attenuation chamber.

To the accomplishment of the foregoing and related ends, the following description and annexed drawings set forth certain illustrative aspects and implementations. These are indicative of but a few of the various ways in which one or more aspects may be employed. Other aspects, advantages and novel features of the disclosure will become apparent from the following detailed description when considered in conjunction with the annexed drawings.

BRIEF DESCRIPTION OF THE DRAWINGS

What is disclosed herein may take physical form in certain parts and arrangement of parts, and will be described in detail in this specification and illustrated in the accompanying drawings which form a part hereof and wherein:

FIG. 15A is another perspective view of the rocking piston vacuum pump shown in

FIG. 12.

It should be understood that the drawings are not necessarily to scale and that the disclosed embodiments are sometimes illustrated diagrammatically and in partial views. In certain instances, details which are not necessary for an understanding of the disclosed methods and apparatuses or which render other details difficult to perceive may have been omitted. It should be understood, of course, that this disclosure is not limited to the particular embodiments illustrated herein.

DETAILED DESCRIPTION

Figure 1:
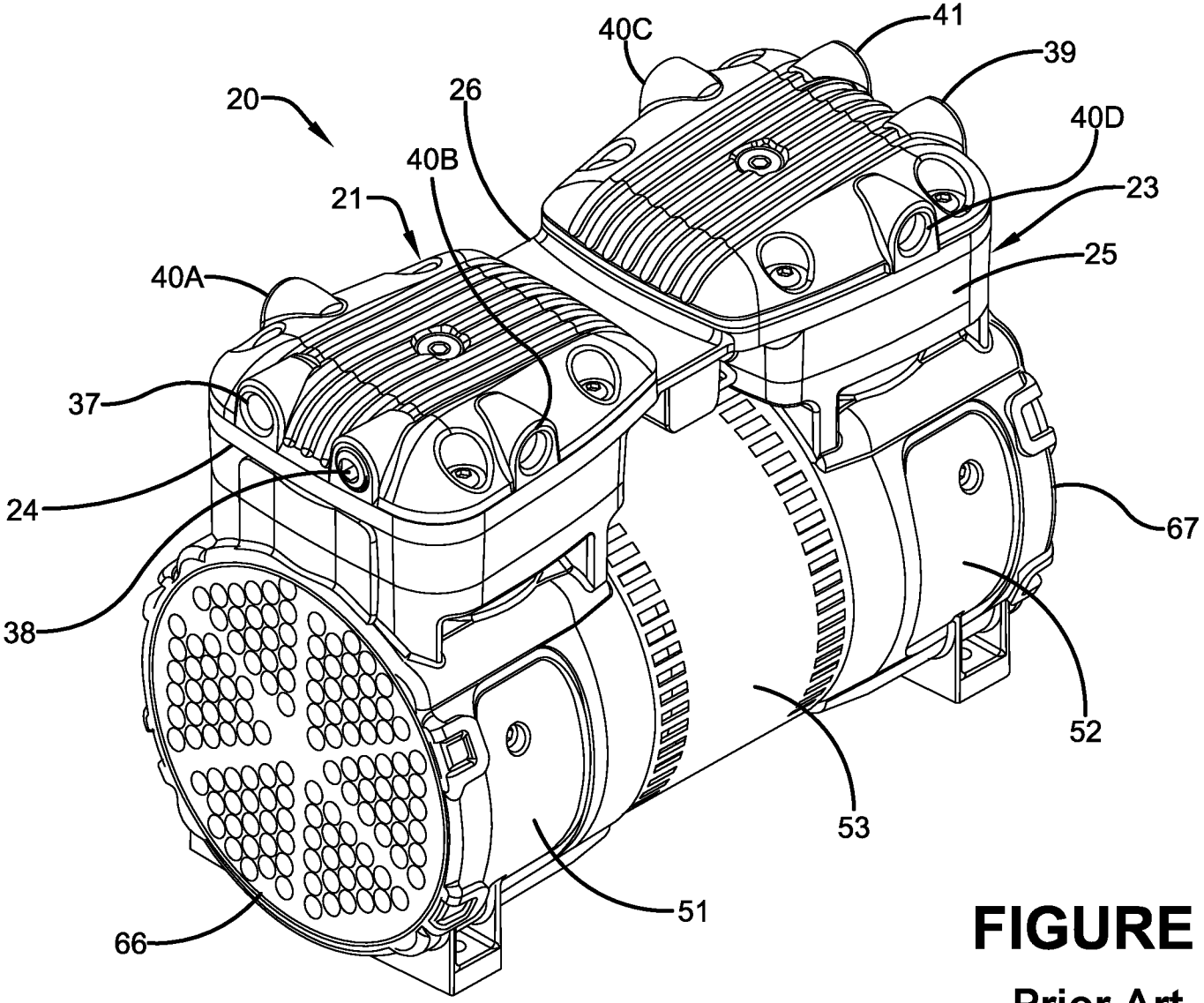
FIGURE 1 Prior Art
FIG. 1 is a perspective view of a disclosed dual cylinder rocking piston compressor.

Prior art FIGS. 1-11 represent a dual cylinder rocking piston-type compressor, as illustrated and described in FIGS. 1-11 of U.S. Pat. No. 9,863,412. FIG. 1 illustrates a disclosed dual cylinder rocking piston-type compressor 20 with two heads 21, 22 that are mounted onto a valve plate body 23 that may include two distinct valve plates 24, 25 that may be coupled together by a crossover passageway housing 26. The two valve plates 24, 25 and crossover passageway housing 26 may be cast together as a single part or individual valve plates 24, 25 may be employed with conduits serving as the crossover passageways (not shown). For example, stiff or flexible tubes may be employed for the intake and exhaust crossover passageways as explained below. In the embodiment shown in FIG. 1, each head 21, 22 slopes towards its respective valve plate 24, 25 respectively as each head 21, 22 extends towards the crossover passageway housing 26. It has been found that this sloping feature of the heads 21, 22 provides for improved flow through the compressor 20 for quieter operation.

Figure 2:
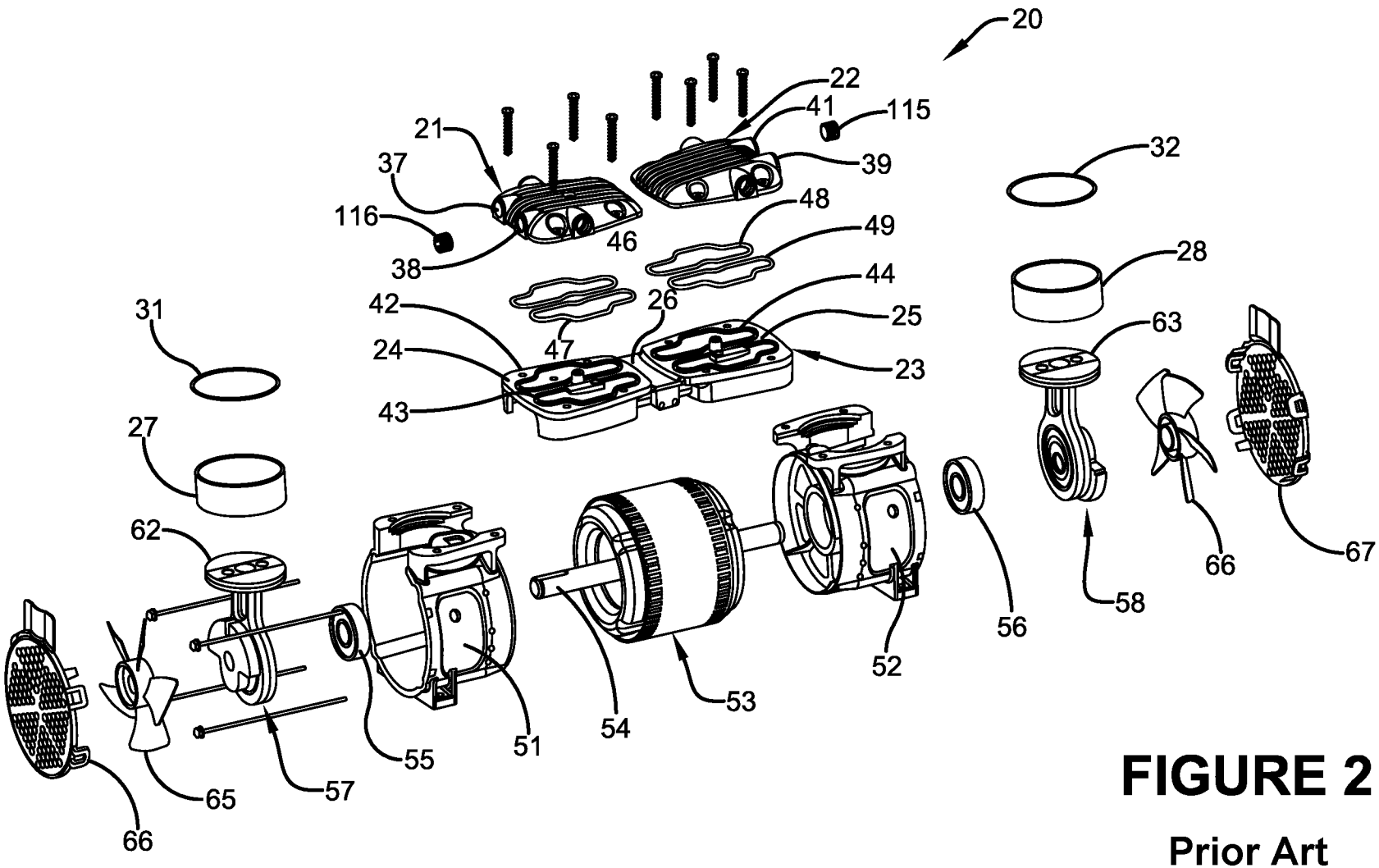
FIGURE 2 Prior Art
FIG. 2 is an exploded view of the compressor shown in FIG. 1.
Figure 3B:
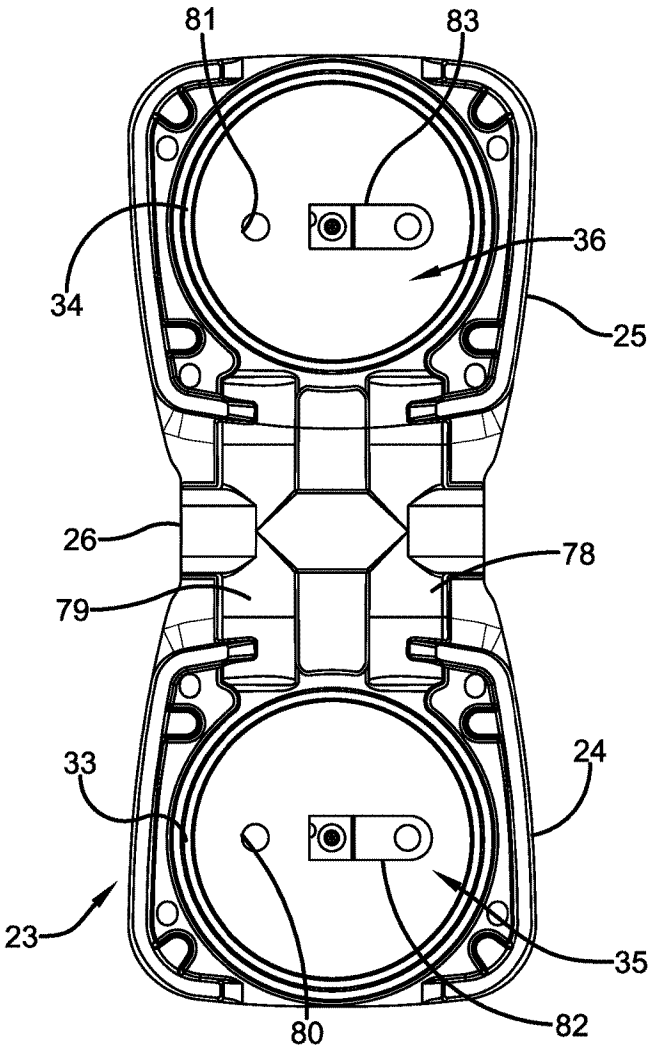
FIGURE 3B Prior Art
FIG. 3B is bottom view of the valve plate assembly of the compressor shown in FIGS. 1 and 2.
Figure 5B:
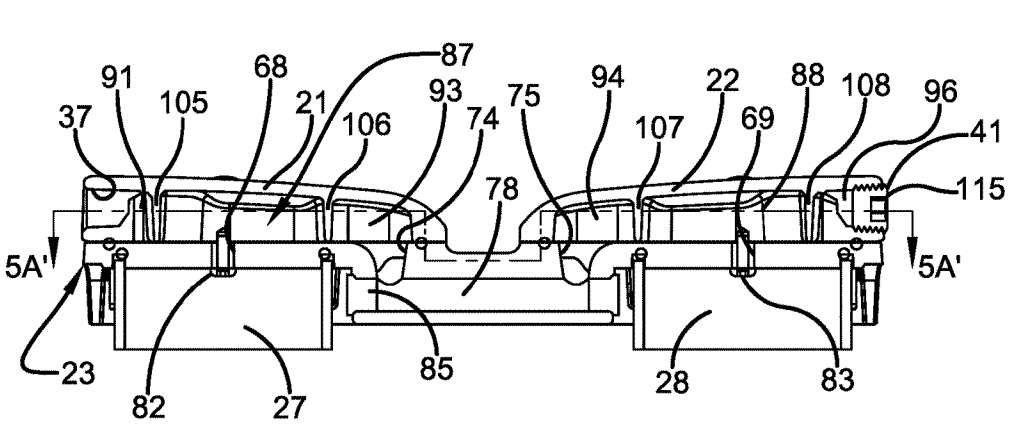
FIGURE 5B Prior Art
FIG. 5B is a sectional view taken substantially along line 5B-5B of FIG. 5A.
Figure 5C:
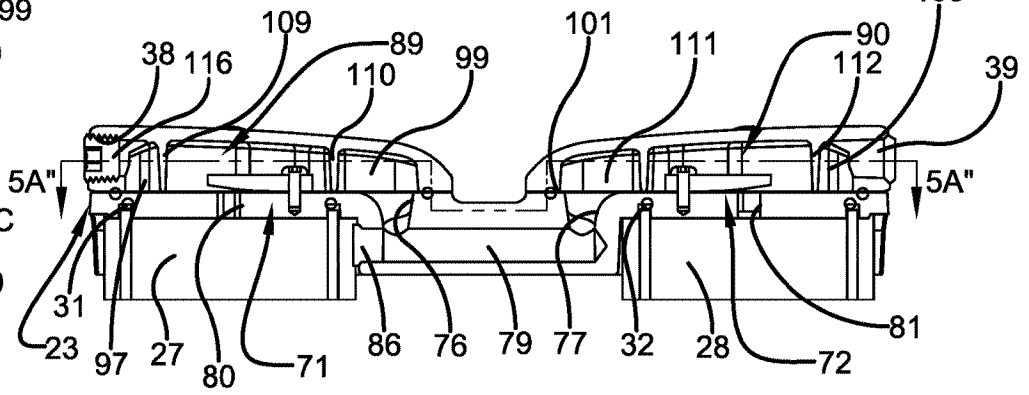
FIGURE 5C Prior Art
FIG. 5C is a sectional view taken substantially along line 5C-5C of FIG. 5A.

Referring to FIGS. 1 and 2, each valve plate 24, 25 may cover a cylinder 27, 28 respectively with a seal 31, 32 that may be sandwiched between each cylinder 27, 28 and a slot 33, 34 disposed on the underside 35, 36 of each valve plate 24, 25 as shown in FIG. 3B. As shown in FIG. 2, each head may include four ports 37, 38, 40*a*, 40*b* (head 21) and 39, 41, 40*c*, 40*d* (head 22). Only a single port is needed for an intake and only a single port is needed for an exhaust but more than one intake and more than one exhaust may be employed. Therefore, the plurality of ports 37, 38, 40*a*, 40*b*, 39, 41, 40*c*, 40*d* enables the user to employ the compressor 20 in a variety of configurations, as will be apparent to those skilled in the art. In the specific configuration illustrated in FIGS. 1-5C, any one or more of the ports 37, 40*a*, 40*c*, 41 may serve as intake ports (or intakes) and any one or more of the ports 38, 40*b*, 39, 40*d* may serve as exhaust ports (or exhausts). However, in the illustrated configuration, the ports 40*a*, 40*c* and 41 are plugged while the port 37 is unplugged and therefore the port 37 serves as a single intake for the compressor 20. Further, because the ports 38, 40*b*, 40*d* are plugged while the port 39 is unplugged, the port 39 serves as a single exhaust for the compressor in the configuration illustrated in FIGS. 1-5C. However, as shown in FIGS. 5B and 5C, the flow path may be easily reversed by removing the plugs 115, 116 from the ports 38, 41 and placing the plugs 115, 116 in the ports 37, 39 thereby enabling the port 41 to serve as the intake and the port 38 to serve as the exhaust (assuming that the side ports 40*a*, 40*b*, 40*c*, 40*d* are plugged). Additionally, the intake and exhaust sides may be reversed by switching the positions of the outlet valves 71, 72 and the inlet valves 82, 83 (see FIGS. 3A-3B). Thus, the compressor 20 is capable of multiple configurations.

As shown in FIGS. 2 and 5B, the valve plates 24, 25 may each include a slot 42, 44 that each may define intake chambers 87, 88 with the heads 21, 22 respectively. Each valve plate 24, 25 may also include slots 43, 45 that each may define exhaust chambers 89, 90 with the heads 21, 22 respectively as shown in FIG. 5C. The slots 42-45 may each accommodate a dedicated seal 46, 47, 48, 49 respectively (FIG. 2). The intake chambers 87, 88 and exhaust chambers 89, 90 along with the various sound attenuation chambers 91, 93, 94, 96, 97, 99, 101, 103 will be described in greater detail below.

Returning to FIG. 2, each cylinder 27, 28 may be disposed within a housing 51, 52 that may be disposed on either side of a motor 53 which rotates the drive shaft 54. The drive shaft 54 may pass through bearings 55, 56 before being coupled to the rocking pistons assemblies 57, 58 which are coupled to the drive shaft 54 by the engagement of a set screw (not shown) extending from the rocking piston assemblies 57, 58 to flats or slots disposed on the motor shaft (only one of which is shown at 59 in FIG. 2). The reader will note from FIG. 2 that the rocking piston assemblies 57, 58 are 180. degree out of phase with each other, meaning that when one piston assembly 57 is performing an exhaust stroke, the other piston assembly 58 is performing an intake stroke and vice versa. Each rocking piston assembly 57, 58 may include piston heads 62, 63 that are slidably and sealably received within the cylinders 27, 28 respectively. Fans 65, 66 may be disposed between the pistons 57, 58 and the ventilated covers 66, 67 respectively for cooling purposes.

Figure 3A:
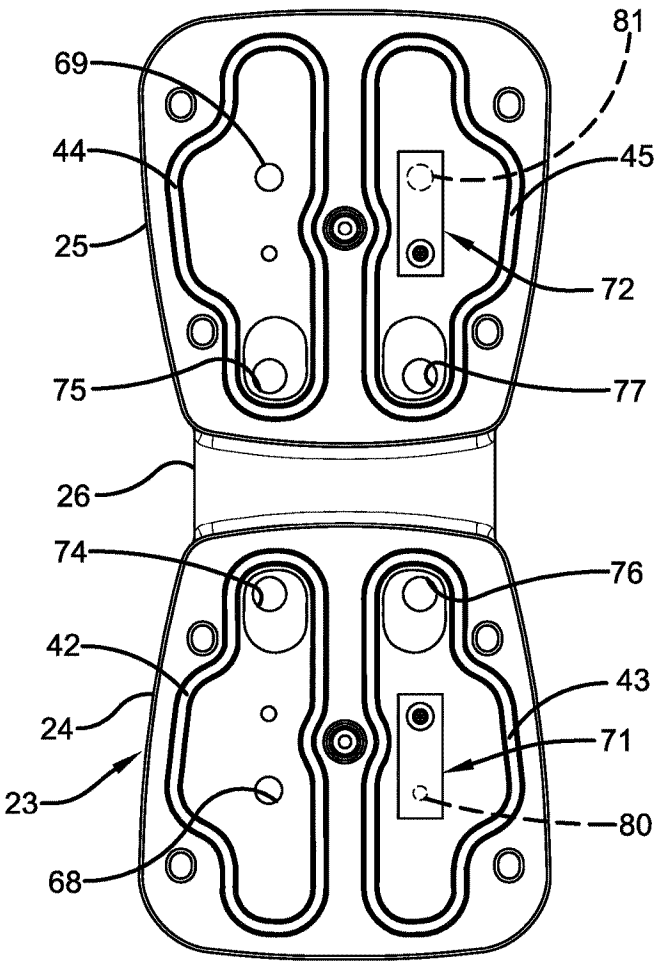
FIGURE 3A Prior Art
FIG. 3A is top view of the valve plate assembly of the compressor shown in FIGS. 1 and 2.
Figure 4:
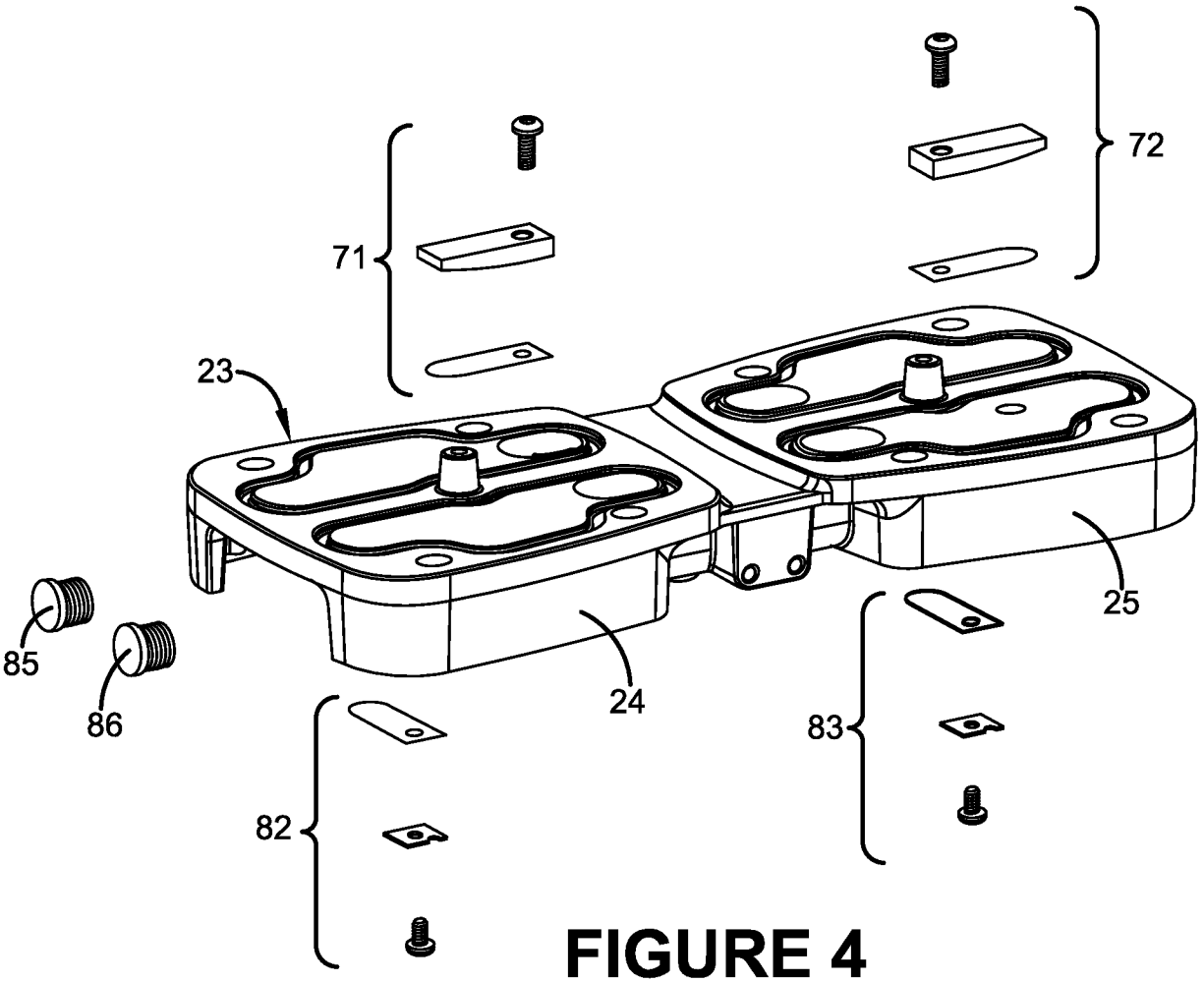
FIGURE 4 Prior Art
FIG. 4 is an exploded view of the valve plate assembly shown in FIGS. 3A and 3B.

The top and bottom sides of the valve plate body 23 and the two valve plates 24, 25 are illustrated in FIGS. 3A-3B respectively. FIG. 3A shows the inlet 68 of the valve plate 24 which leads to the cylinder 27 while FIG. 3B shows the inlet valve 82 of the valve plate 24 disposed beneath the inlet 68 and within an upper portion of the cylinder 27. Similarly, FIG. 3A shows the inlet 69 of the valve plate 25 which leads to the cylinder 28 while FIG. 3B shows the inlet valve 83 disposed beneath the inlet 69 and within an upper portion of the cylinder 28. FIG. 3A also shows the exhaust valve 71 for the valve plate 24 and the cylinder 27 as well as the exhaust valve 72 for the valve plate 25 and the cylinder 28. FIG. 3A further shows an inlet 74 of the intake crossover passageway 78 (FIGS. 3B and 5B) as well as an outlet 75 of the intake crossover passageway 78. FIG. 3A also shows an inlet 76 of the exhaust crossover passageway 79 (FIGS. 3B and 5C) and an outlet 77 of the exhaust crossover passageway 79.

FIG. 3B illustrates the crossover passageway housing 26 for the intake and exhaust crossover passageways 78, 79. FIG. 3B also shows the inlet valve 82 disposed beneath the inlet 68 that leads to the cylinder 27 and the inlet valve 83 disposed beneath the inlet 69 that leads to the cylinder 28. An exploded view of the valve plate body 23, the exhaust valve 71, the inlet valve 82, and the inlet valve 83 is provided in FIG. 4. The plugs 85, 86 seal one end of each crossover passageway 78, 79 respectively as shown in FIGS. 5B-5C.

Figure 5A:
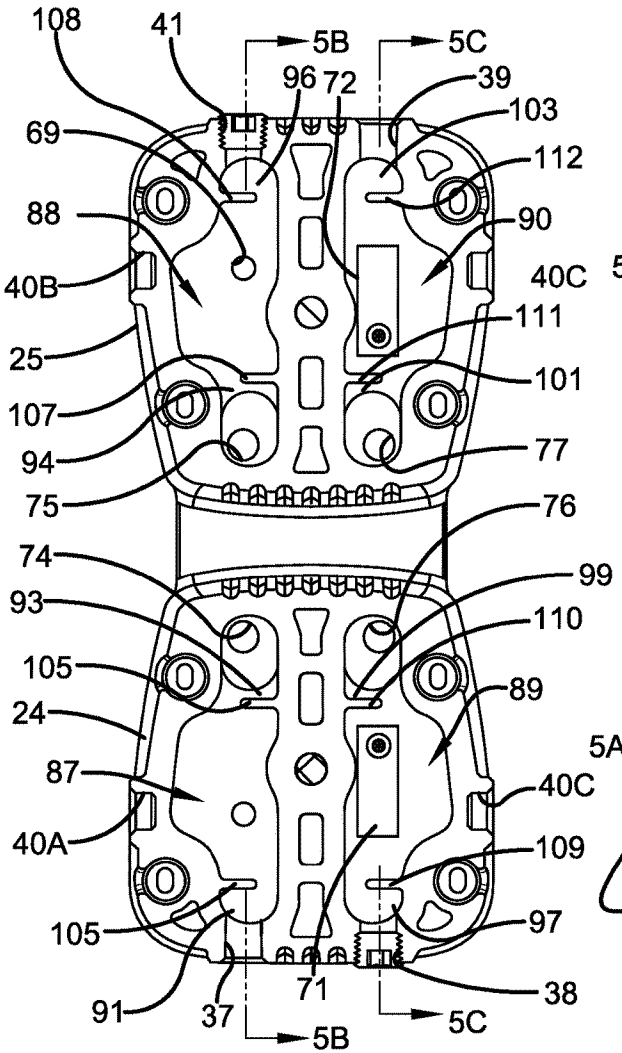
FIGURE 5A Prior Art
FIG. 5A is a sectional view taken substantially along lines 5A'-5A' of FIGS. 5B and 5A"-5A" of FIG. 5C.
Figure 6B:
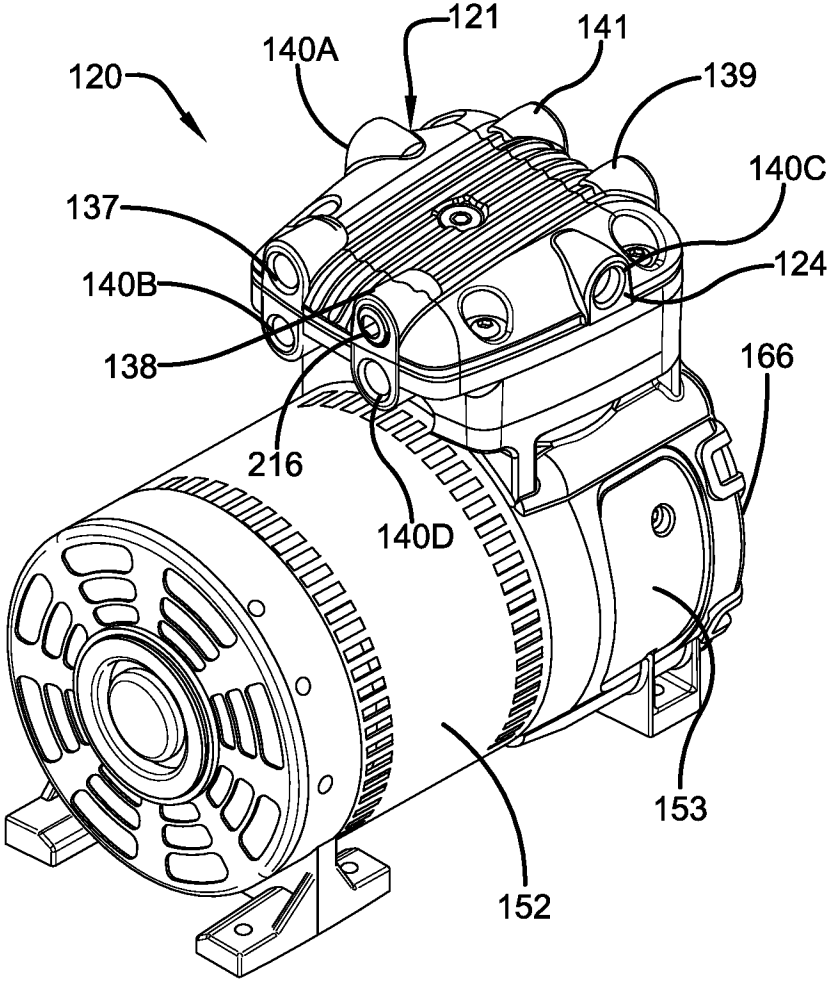
FIGURE 6B Prior Art
FIGS. 6A and 6B are perspective views of a disclosed single cylinder rocking piston compressor with multiple intake and exhaust ports for multiple configurations.
Figure 6A:
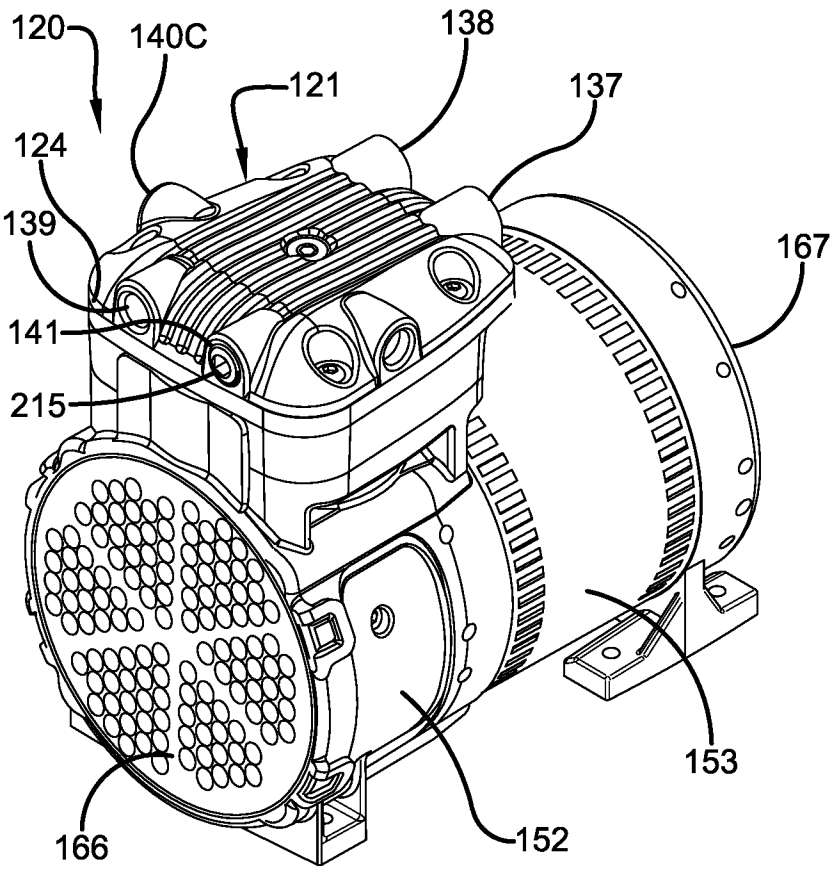
FIGURE 6A Prior Art

FIGS. 5A-5C illustrate the flow of air or gas through the chambers 87-90, 91, 93-94, 96, 97, 99, 101, 103 that are defined by the valve plate body 23 and the heads 21, 22. As noted above and shown in FIGS. 5B and 5C, the first and second valve plates 24, 25 and the heads 21, 22 may define first and second intake chambers 87, 88 respectively and first and second exhaust chambers 89, 90 respectively. The first and second intake chambers 87, 88 and the first and second exhaust chambers 89, 90 may be in communication with one or more sound attenuation chambers 91, 93 (intake chamber 87), 94, 96 (intake chamber 88), 97, 99 (exhaust chamber 89) and 101, 103 (exhaust chamber 90) via the baffles 105-112 as best seen in FIG. 5A.

As shown in FIG. 5B, air or gas enters the compressor 20 through the intake 37 before it passes through the sound attenuation chamber 91 and past the baffle 105 before it enters the intake chamber 87. The air or gas flows from the intake chamber 87, past the baffle 106 before entering the sound attenuation chamber 93 and the crossover passageway inlet 74, which directs the air or gas into the crossover passageway 78. The crossover passageway outlet 75 permits said air or gas to flow from the crossover passageway 78 through the sound attenuation chamber 94, past the baffle 107 and into the other intake chamber 88. As the air or gas flows through the intake side of the compressor 20, it is drawn downward through the inlets 68, 69 and into the cylinders 27, 28 where it is compressed.

Conversely, as shown in FIG. 5C, air exits the compressor through the outlets 80, 81 before entering the exhaust chambers 89, 90. The crossover passageway inlet 76 receives air or gas from the exhaust chamber 89 after it passes the baffle 110 and after it passes through the sound attenuation chamber 99 before it is directed into the crossover passageway 79. The outlet 77 communicates the air or gas from the crossover passageway 79 into the sound attenuation chamber 101, past the baffle 111 and into the exhaust chamber 90. The air or gas then passes the baffle 112, proceeds through the sound attenuation chamber 103 and exits the compressor 20 through the exhaust port 39.

The additional port 41 may be sealed by the plug 115 and the additional port 38 may be sealed by the plug 116. However, as noted above, the direction of the flow may be reversed by using the port 41 as a single intake and the port 38 as a single exhaust. The side ports 40*a*, 40*b*, 40*c*, 40*d* may also be plugged, used as auxiliary intakes (ports 40*a*, 40*b*), auxiliary exhausts (ports 40*c*, 40*d*) or as single intakes or exhausts, depending on the desired configuration. As will be apparent to those skilled in the art, multiple configurations are available and an exhaustive list need not be mentioned here.

Still referring to FIGS. 5B-5C, the crossover passageways 78, 79 may be drilled and plugs 85, 86 may be used to seal the open ends of the crossover passageways caused by the drilling operation.

The flow through the compressor 20 for the illustrated configuration may be described in connection with FIGS. 5A-5C. The first intake chamber 87 may be a sound attenuation chamber itself and may be in communication with one or more sound attenuation chambers 91, 93. Gas/air flows through the intake port 37 and into the sound attenuation chamber 91 before passing the baffle 105 and entering the intake chamber 87 before passing the baffle 106 and entering the sound attenuation chamber 93. The air/gas then proceeds through the inlet 74 to the crossover passageway 78 before exiting through the outlet 75 and entering the sound attenuation chamber 94. The air or gas passes the baffle 107 before reaching the second intake chamber 88. The intake chamber 88 may also be in communication with the sound attenuation chamber 96 in addition to the sound attenuation chamber 94. In the first intake chamber 87, part of the air/gas proceeds through the inlet 68 and past the inlet valve 82 before it is compressed in the cylinder 27. In the second intake chamber 88, part of the air/gas also proceeds through the inlet 69 and past the inlet valve 83 before it is compressed in the cylinder 28.

After the air/gas is compressed in the cylinder 27, it passes upward through the outlet 80 and exhaust valve 71 and into the first exhaust chamber 89. The air then proceeds past the baffle 110, through the sound attenuation chamber 99 and through the inlet 76 to the crossover passageway 79 before exiting the crossover passageway through the outlet 77 and entering the sound attenuation chamber 101. The air/gas then passes the baffle 111 before entering the second exhaust chamber 90. Additional air/gas exits the cylinder 28 through the outlet 81 and exhaust valve 72 before entering the second exhaust chamber 90 and passing the baffle 112 as it enters the sound attenuation chamber 103 before it exits through the exhaust port 39.

As air/gas enters the intake 37 and expands in the sound attenuation chamber 91 before it is compressed as it passes the baffle 105. The air/gas expands again in the larger intake chamber 87 (see FIG. 5A). The increases and decreases in volume and/or pressure as the air passes through the intake port 37, through the sound attenuation chamber 91, past the baffle 105 and into the larger intake chamber 87 provides a sound attenuation effect. The air/gas is then compressed again as it proceeds past the baffle 106 before expanding as it proceeds through the sound attenuation chamber 93 and onto the inlet 74. In addition to the sound attenuation provide by the chamber 93, the cross-sectional diameter of the crossover passageway 78 is larger than the minimum diameter of the inlet 74, which causes the air/gas to expand again thereby providing the crossover passageway 78 with sound attenuation effects as well. As the air proceeds through the narrow portion of the outlet 75, it expands as it enters the sound attenuation chamber 94. As air passes the baffle 107, it is compressed again before entering the large intake chamber 88, which also provides a sound attenuation effect before the air/gas enters the cylinder 28 through the inlet 69. The valve plate 25 may include the baffle 108 to form a sound attenuation chamber 96 when the additional port 41 is used as the intake.

Similarly, referring to FIG. 5C, as air exits the cylinder 27, it passes through the exhaust valve 71 and expands in the exhaust chamber 89 before being compressed as it flows past the baffle 110 before expanding yet again as it enters the sound attenuation chamber 99. Then, the air/gas passes through the relatively narrow inlet 76 and into the crossover passageway 79 which has a larger diameter than the minimum diameter of the inlet 76 thereby providing a sound attenuation effect for the crossover passageway 79. The air/gas then contracts as it enters the outlet 77 before expanding as it enters the sound attenuation chamber 101 before being compressed as it passes the baffle 111. The air/gas then expands again as it enters the exhaust chamber 90. Air/gas exits the cylinder 28 through the exhaust valve 72 and into the exhaust chamber 90 before being compressed as it passes the baffle 112 and enters the final sound attenuation chamber 103 before exiting through the exhaust port 39.

Without being bound by theory, it is believed that the various disclosed sound attenuation chambers, intake chambers exhaust chambers and sloping heads, in combination with the baffles, provide expansion and compression of the air/gas as it proceeds through the sound attenuation chambers (and intake and exhaust chambers) and past the baffles before exiting through the exhaust port provides significant sound attenuation properties. These improved sound attenuation properties are presented in FIG. 11 where the line 300 represents the sound level of a conventional dual cylinder rocking piston type compressor and the line 301 represents the sound level of the disclosed dual cylinder rocking piston-type compressor 20.

A single cylinder rocking piston compressor 120 is illustrated in FIGS. 6A-10C. The compressor 120 may comprise a head 121 that covers a valve plate 124. The head 121 may include a plurality of ports 137, 138, 139, 141, 140*a*, 140*b*, 140*c*, 140*d*. Like the compressor 20 shown in FIGS. 1-5C, the head 121 slopes towards the valve plate 124 as the head 121 extends from one end of the valve plate 124 to the other end of the valve plate 124. The sloping configuration of the head 121 results in a reduction in the size of the chamber(s) defined by the head 121 and valve plate 124 for improved flow and quieter operation of the compressor 120.

In the configuration illustrated, all of the ports except the intake 137 and exhaust 139 are plugged, but the ports 140*a*, 140*c* and 141 could also serve as intakes and the ports 140*b*, 140*d*, and 138 could also serve as exhausts. Further, the intake and exhaust sides of the compressor 120 may be reversed in addition to the flow direction, as explained above in connection with the compressor 20 of FIGS. 1-5C. Thus, the compressor 120 may assume multiple configurations like the compressor 20 discussed above and each configuration need not be listed here.

To reverse the flow direction of the compressor 120, the plug 215 can be moved from the intake port 141 to seal the exhaust port 139 and the plug 216 can be removed from the exhaust port 138 to plug the intake port 137. That arrangement (not shown in FIG. 6A, 6B or 7) would establish the intake at the port 141 and the exhaust at the port 138. As noted above, with the configuration of the inlet valve 171 (FIG. 8A) and the exhaust valve 182 (FIG. 8B), the port 140*a* may also be used as an intake and/or the port 140*c* may be used as an exhaust. Further, the ports 140*b* may be used as an intake and/or the port 140*d* may be used as an exhaust (and vice versa is the positions of the valves 171, 182 are switched). Use of the ports 140*b*, 140*d* as the intake and exhaust may lower the profile of the compressor 120 when various plumbing accessories such as intake and exhaust filters and mufflers are attached. As an alternate construction (not shown) of valve plate body 23 used in the construction of compressor 20 (dual cylinder compressor), two valve plates 124 may have ports 140*b* and 140*d* modified to receive separate intake and exhaust chamber passageways of various construction methods, thereby providing communication between each valve plate. This alternate construction provides flexibility for future dual cylinder compressor configurations where a longer motor 53 with more power may be required to further expand the performance range of the compressor.

Figure 7:
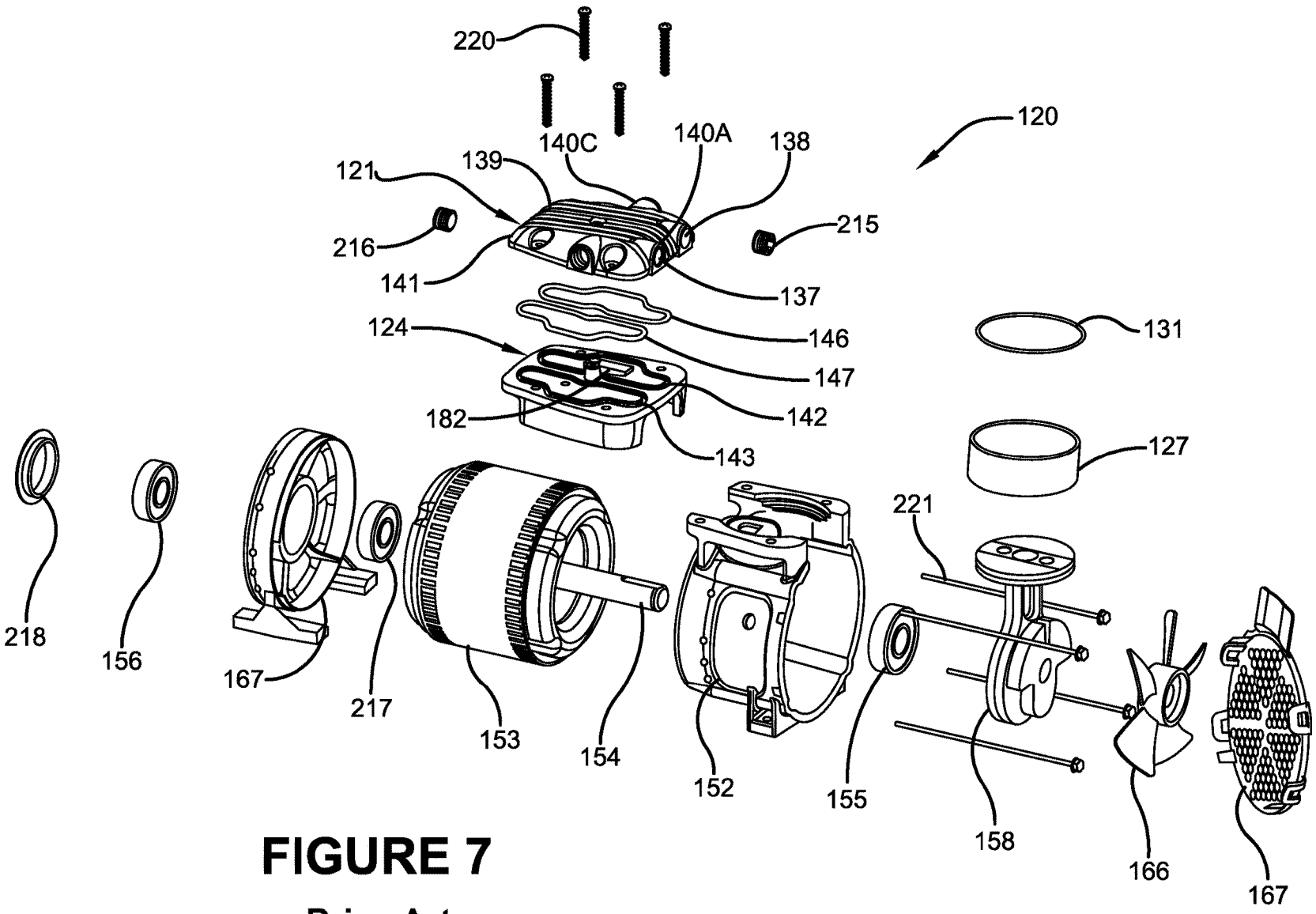
FIGURE 7 Prior Art
FIG. 7 an exploded view of the compressor shown in FIG. 6.
Figure 10B:
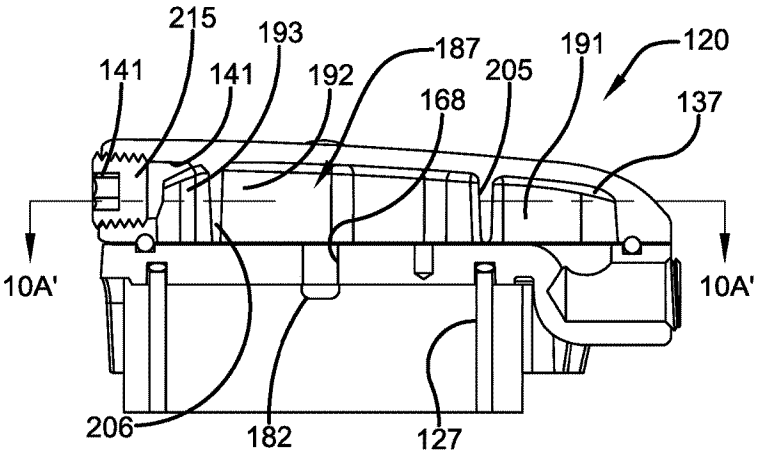
FIGURE 10B Prior Art
FIG. 10B is a sectional view taken substantially along line 10B-10B of FIG. 10A.
Figure 10C:
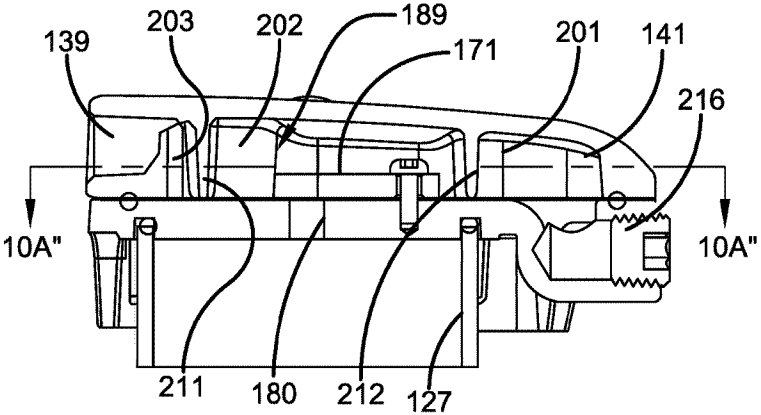
FIGURE 10C Prior Art
FIG. 10C is a sectional view taken substantially along line 10C-10C of FIG. 10A.
Figure 10A:
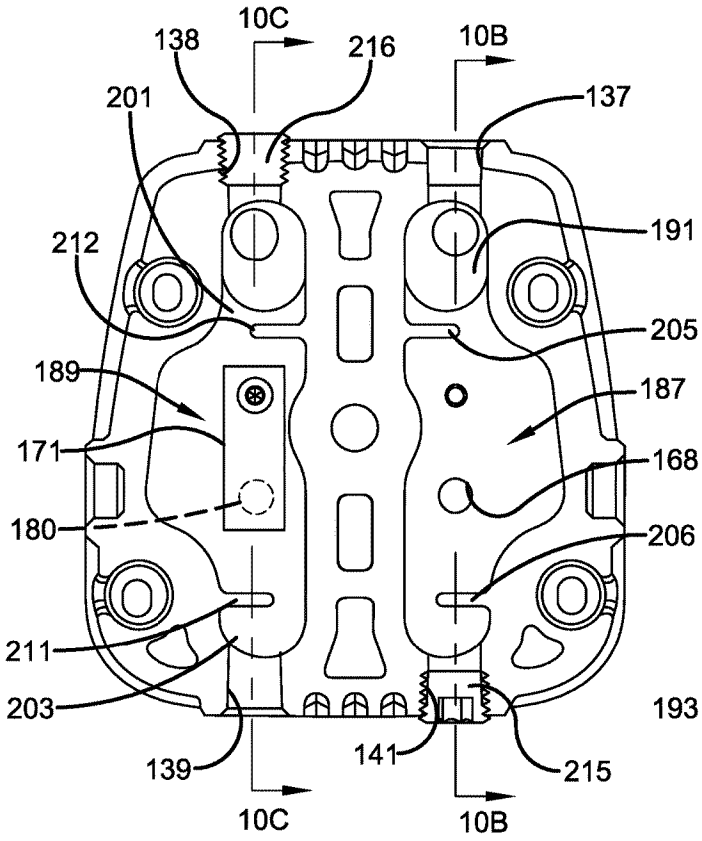
FIGURE 10A Prior Art
FIG. 10A is a sectional view taken substantially along lines 10A'-10A' of FIGS. 10B and 10A"-10A" of FIG. 10C.

Turning to FIG. 7, dedicated seals 146, 147 may be accommodated in the channels 142, 143 respectively for purposes of defining an intake chamber 187 and an exhaust chamber 189 and the related sound attenuation chambers 191, 193, 201, 203 (see FIGS. 10A-10C). Still referring to FIG. 7, the valve plate 124 may be used to cover a cylinder 127. An O-ring seal 131 may be sandwiched between the cylinder 127 and the underside of the valve plate 124. The compressor motor 153 may rotate a drive shaft 154, which may pass through a bearing 155 before it passes through the rocking piston assembly 158 and the fan 166. The drive shaft 154 may also pass through an additional ring 156 and a bushing 217. The motor may be partially accommodated in and supported by the main housing 152 and a ventilated end housing 167. A ventilated cover 166 may be coupled to the main housing 152 for purposes of protecting the fan 166. The bearing 166 may be covered by an end cap 218. Various fasteners are shown at 220, 221 for purposes of holding the compressor 120 together.

Figure 8B:
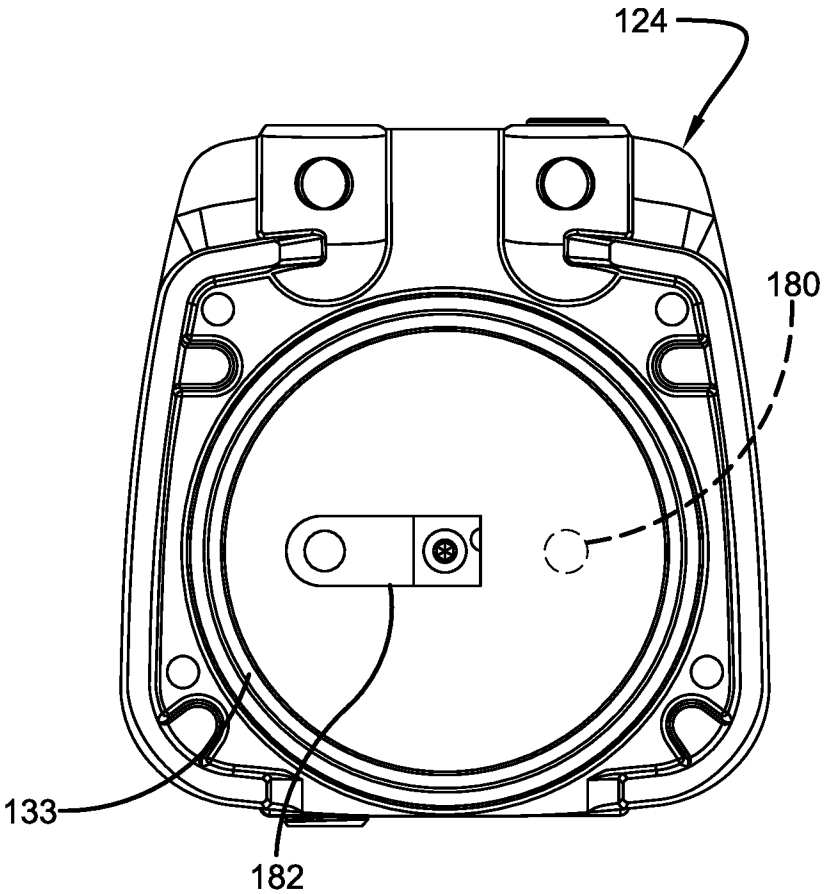
FIGURE 8B Prior Art
FIG. 8B is bottom view of the valve plate assembly of the compressor shown in FIGS. 6-7.
Figure 8A:
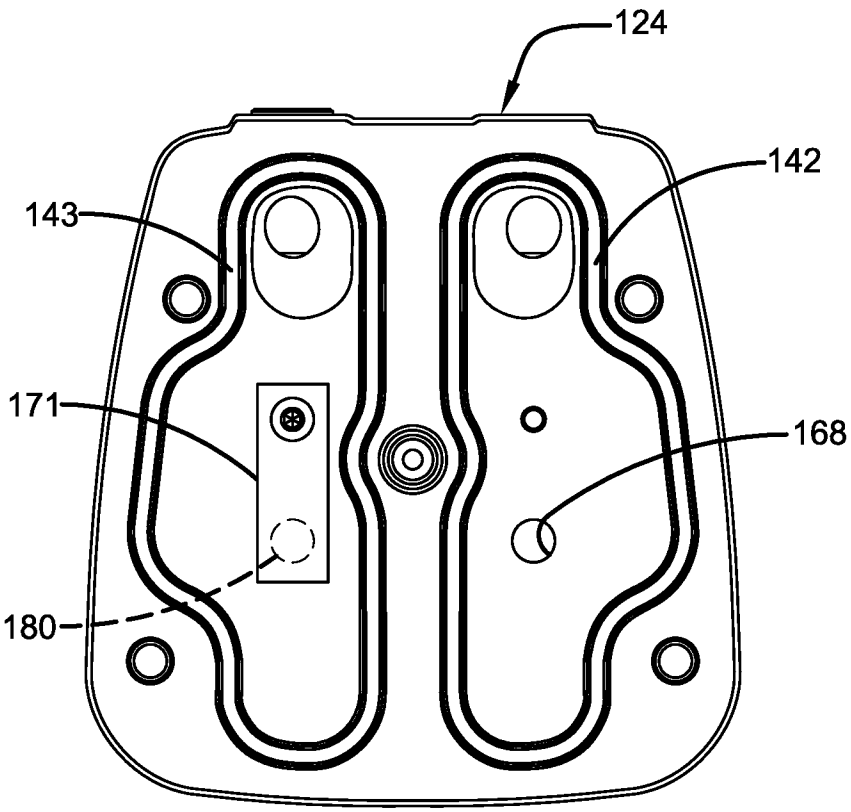
FIGURE 8A Prior Art
FIG. 8A is top view of the valve plate assembly of the compressor shown in FIGS. 6-7.

Turning to FIGS. 8A-8B, top and bottoms views of the valve plate 124 are shown. The valve plate 124 may include slots or grooves 142, 143 for purposes of accommodating the seals 146, 147 respectively (see FIG. 7). An exhaust valve 171 may cover an outlet 180. An intake valve 82 covers the underside of the inlet 168 shown in FIG. 8A while the exhaust valve 171 covers the upper side of the outlet 180. A slot or groove 133 accommodates the O-ring 131 shown in FIG. 7.

Figure 9:
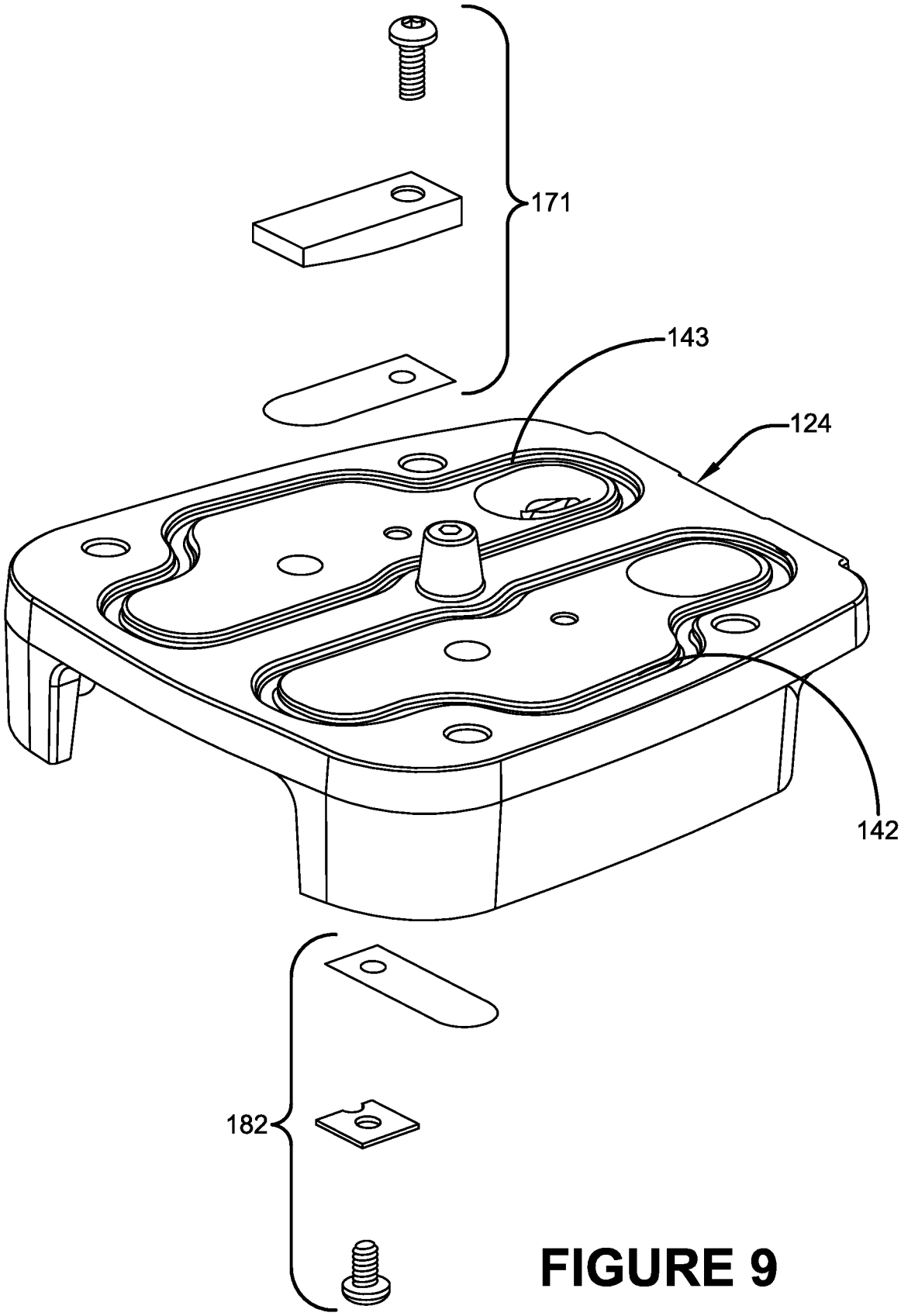
FIGURE 9 Prior Art
FIG. 9 is an exploded view of the valve plate assembly shown in FIGS. 8A and 8B.

FIG. 9 is an exploded view of the valve plate 124, exhaust valve 171, and intake valve 182. FIGS. 10A-10C illustrates the air/gas flow through the compressor 120. Air enters through the intake port 137 and passes into the intake chamber 187. The intake chamber 187 may be in communication with a plurality of sound attenuation chambers 191, 193. The sound attenuation chambers 191, 193 may be defined by the baffles 205, 206 as well as the head 121 and valve plate 124. Further, as discussed above in connection with the compressor 20 illustrated in FIGS. 1-5C, successive expansions and contractions of the volume or cross-sectional area through which the air/gas passes provides sound attenuation. Therefore, as air/gas enters the intake port 137, it expands into the sound attenuation chamber 191 before it is compressed again as it passes the baffle 205. The air/gas is then expanded again as it enters the large intake chamber 187. The gas/air exits the intake chamber 187 through the inlet 168 as it passes through the intake valve 182 (FIG. 10B). The sound attenuation chamber 193 and baffle 206 assists with sound attenuation, but also acts as a sound attenuation chamber when the additional port 141 is used as the intake.

Turning to FIG. 10C, air/gas exits the cylinder 127 through the outlet 180 and past the exhaust valve 171 before it enters the exhaust chamber 189. Similar to the intake chamber 187, the exhaust chamber 189 may be in communication with a plurality of sound attenuation chambers 201, 203 that may be defined by the baffles 211, 212, the head 121 and valve plate 124. As air/gas passes upward through the outlet 180 and past the exhaust valve 171, it expands into the large exhaust chamber 189. As the air/gas moves toward the exhaust port 139, it is compressed as it passes the baffle 211 before it is expanded again in the sound attenuation chamber 203 prior to exiting the compressor 120 through the exhaust 139. The baffle 212 and the sound attenuation chamber 201 provide sound attenuation benefits, but are used primarily when the additional port 141 serves as the exhaust.

Figure 11:
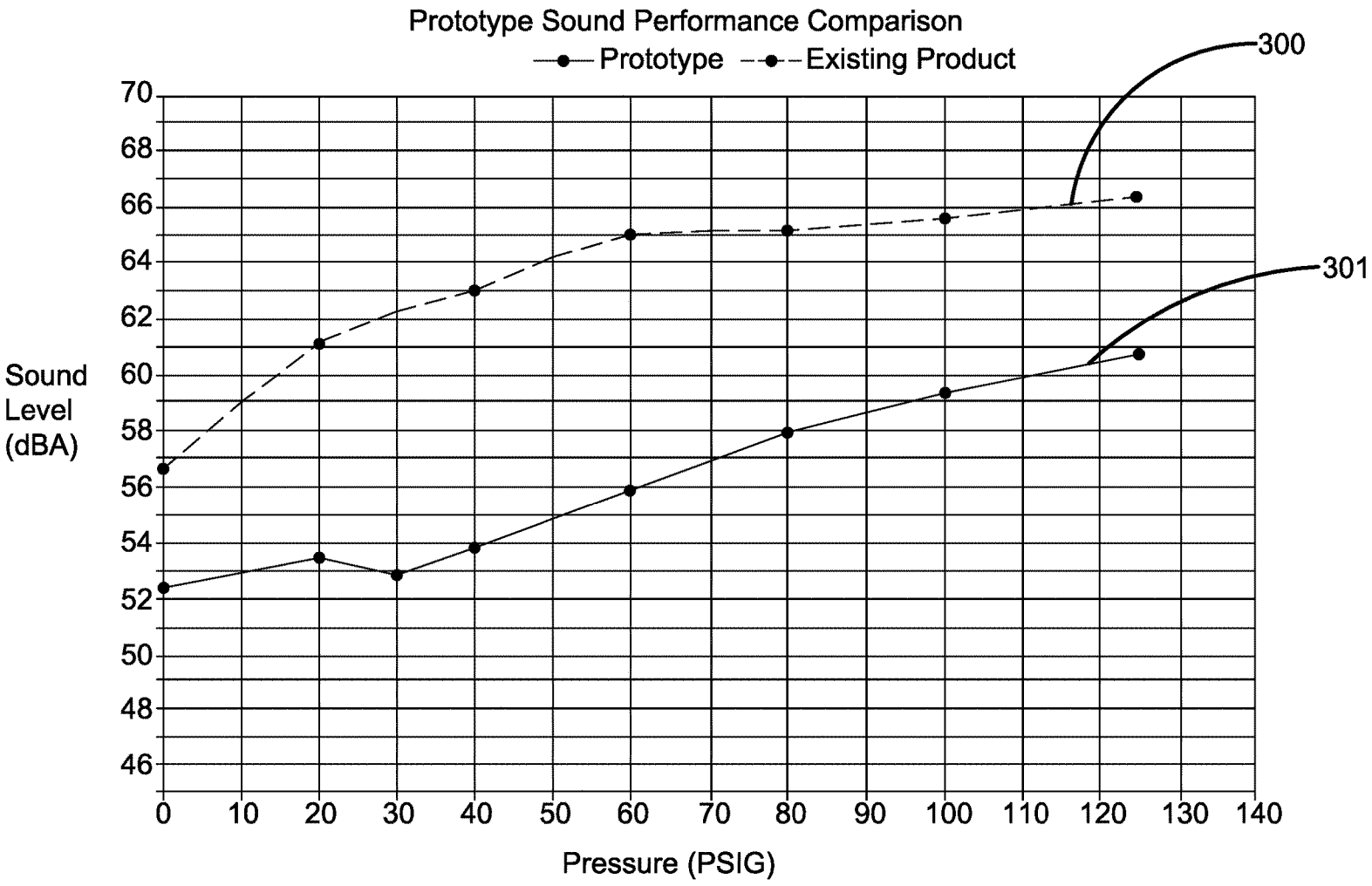
FIGURE 11 Prior Art
FIG. 11 graphically illustrates a sound performance comparison of the disclosed dual cylinder rocking piston compressor vs. a prior art dual cylinder rocking piston compressor with the inlet and outlet plumbed away.
Figure 12:
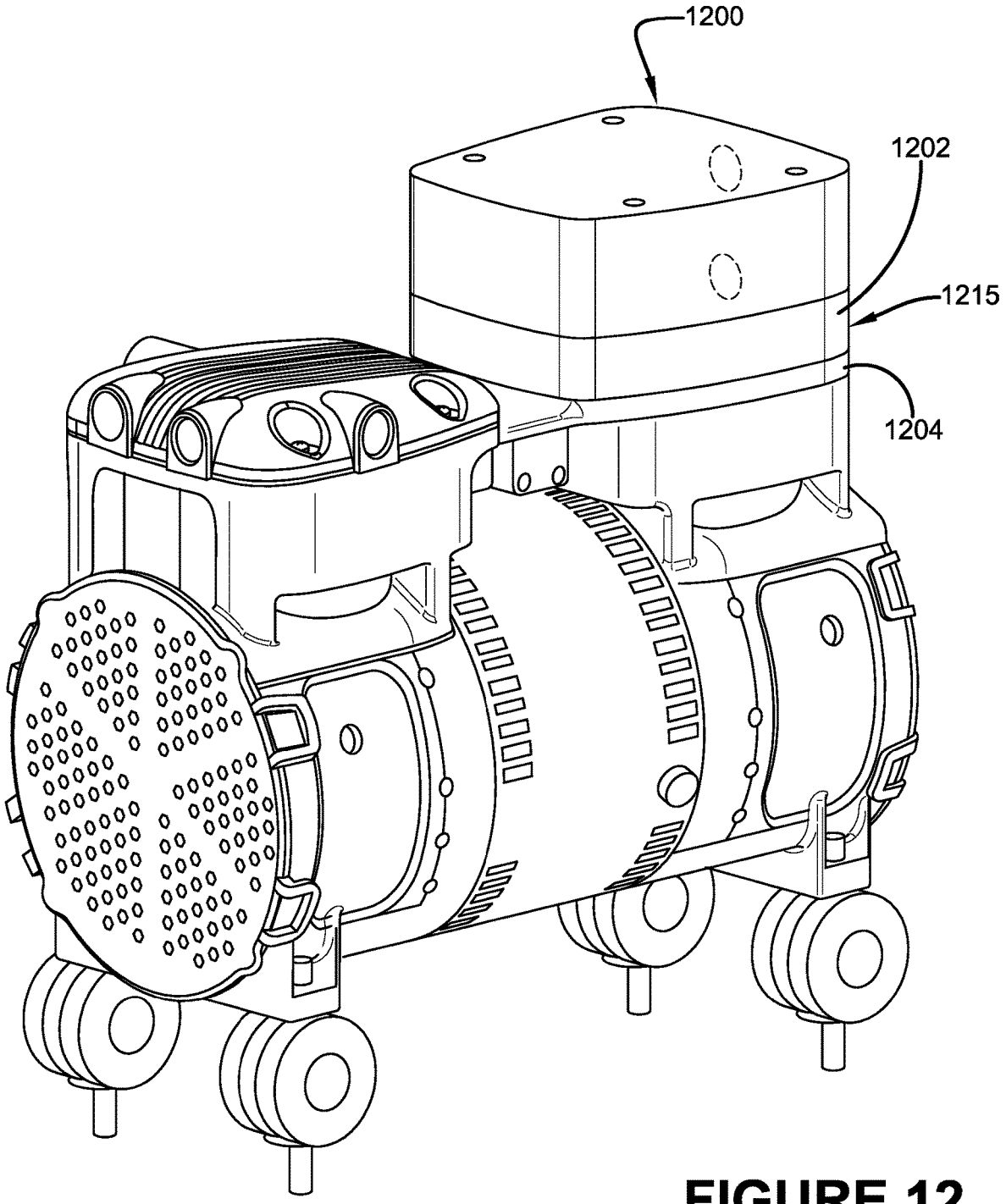
FIG. 12 is a perspective view of another implementation of a dual cylinder rocking piston vacuum pump.
Figure 13:
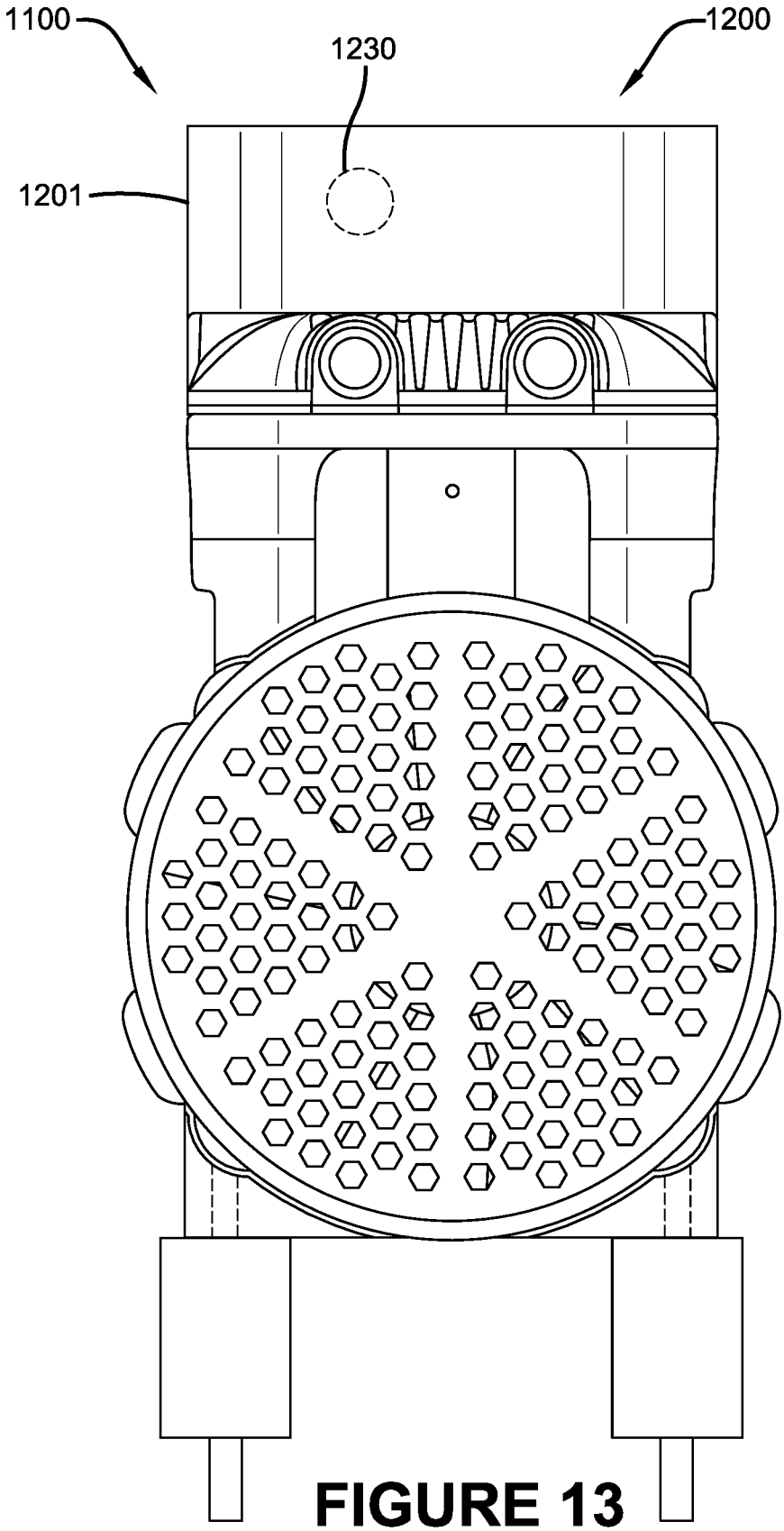
FIG. 13 is a left side view of FIG. 12.
Figure 14:
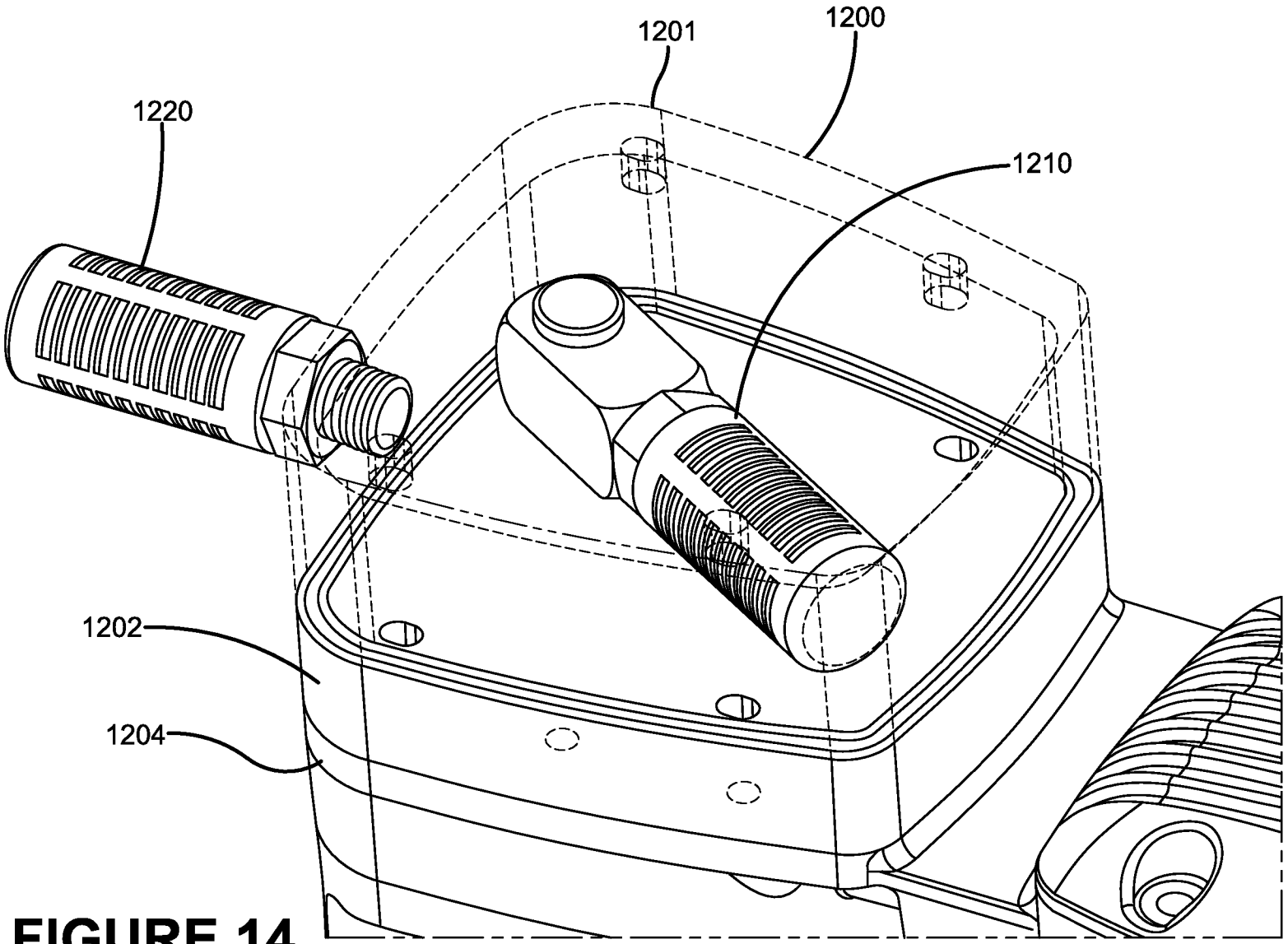
FIG. 14 is a perspective view of FIG. 12.
Figure 15A:
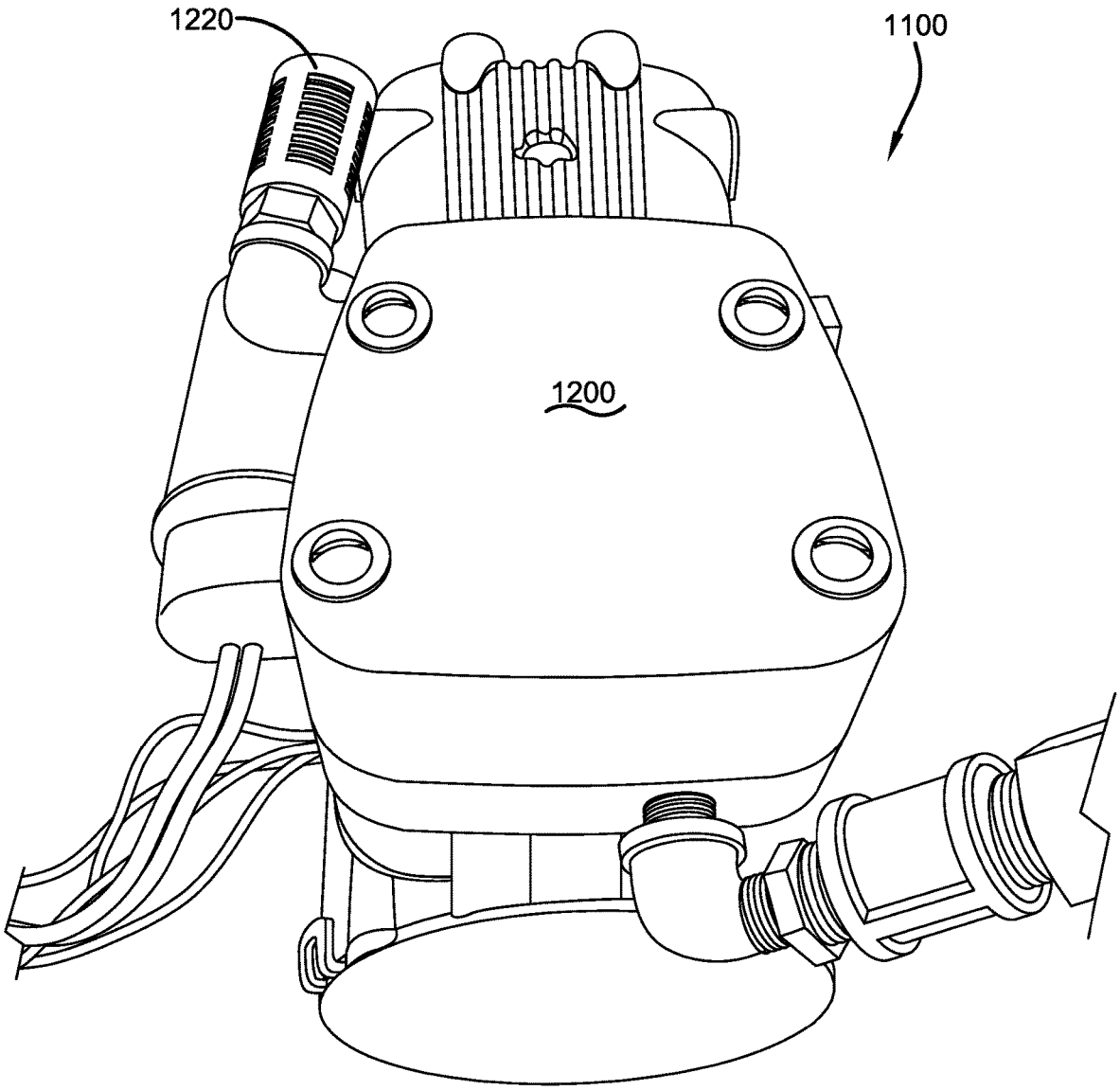
Figure 15B:
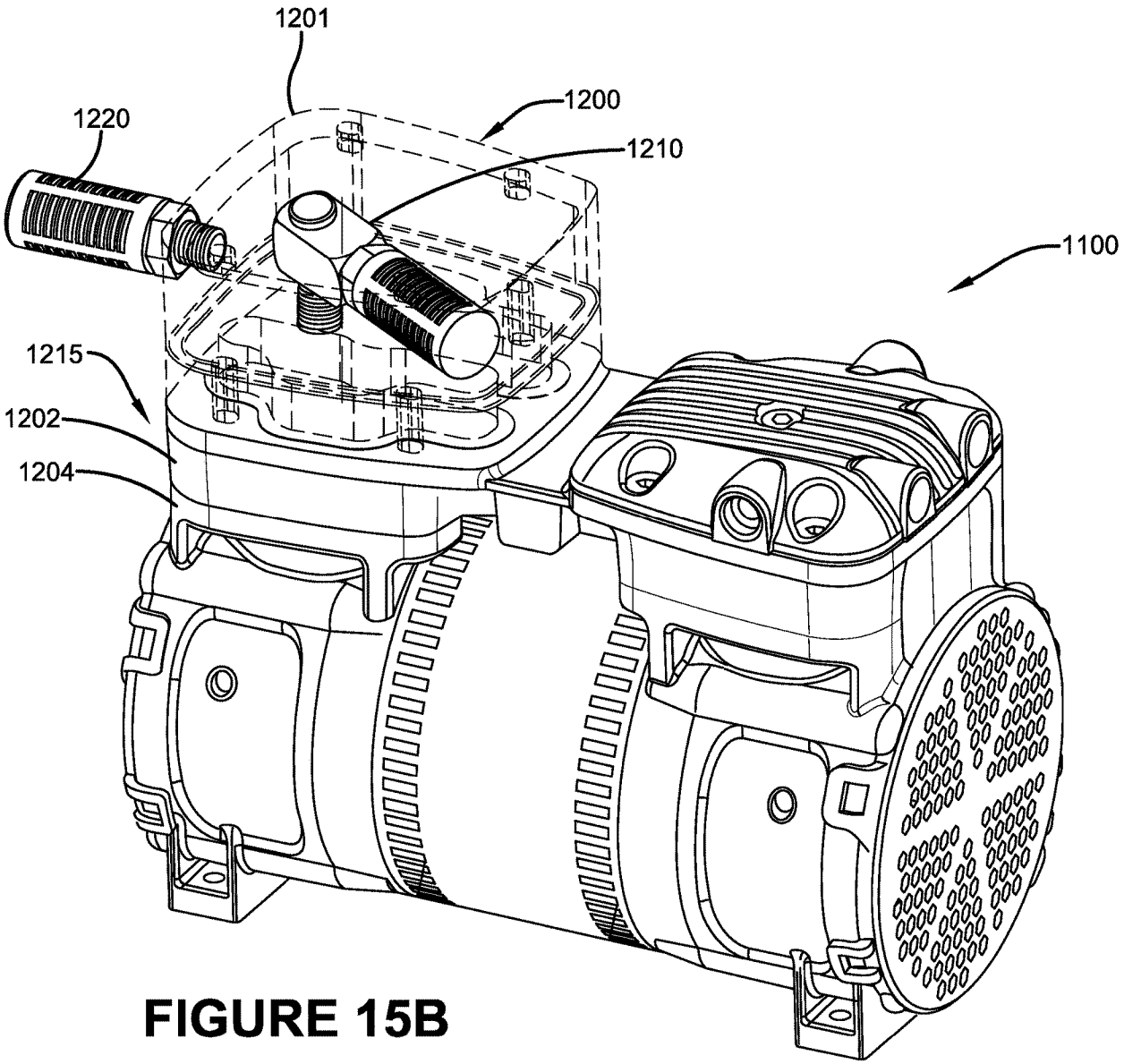
FIG. 15B is a perspective view of the rocking piston vacuum pump shown in FIG. 12.

As suggested above in regard to the compressor 20 of FIGS. 1-5C, without being bound by theory, it is believed that the successive expansions and contractions of the air or gas passing through the compressor 120 provides significant sound attenuation as graphically illustrated in FIG. 11 even though the curve 301 was generated with a dual rocking piston compressor 20 as opposed to a single cylinder rocking piston compressor 120.

With reference to FIGS. 12-19 another implementation of a sound attenuation assembly 1200 is described. FIGS. 12-19 show example implementations of the sound attenuation assembly utilized for vacuum applications and pressure applications that may apply to pumps and/or compressors. Pressure applications and vacuum applications may utilize a single head or a dual head. In one example implementation, pressure applications may utilize a silencer at an inlet of the sound attenuation chamber 1200. In another example implementation, vacuum applications may utilize a silencer at an exhaust or outlet of the sound attenuation chamber.

The sound attenuation assembly 1200 may be utilized with a compressor or a vacuum pump. In another implementation, the sound attenuation assembly 1200 may be utilized with a rocking piston compressor or a rocking piston vacuum pump. In one implementation, the sound attenuation assembly may be selectably removable from the head of the vacuum pump or compressor. The sound attenuation assembly may be sold as a kit to retrofit onto existing compressors and pumps. In one example implementation, by disposing two mufflers, as described below in series, decibel levels may be reduced. In one implementation sound levels may be reduced from about 69 dB(A) (20 Sones) to about 54 dB(A) (9.6 Sones) consistently, when intake air is plumbed away from a sound room (not shown) and the outlet exhausts to the atmosphere within the sound room.

As shown in FIG. 12-19, the sound attenuation assembly 1200 may comprise an exhaust sound attenuation chamber 1201. In one implementation, the sound attenuation chamber 1201 may replace one of the heads of the compressor or pump. The sound attenuation chamber 1201 may comprise one or more ports 1230. Ports 1230 may be an inlet port 1230*a* or an outlet port 1230*b*. The sound attenuation chamber 1201 may be operably connected to a base 1204. The sound attenuation chamber 1200 may comprise a first silencer 1210 or muffler. The first silencer 1210 or muffler may be internal. In one implementation, the first silencer 1210 may be a SMC ANA1-02. The internal silencer 1210 may be partially or completely engulfed or surrounded with sound dampening foam 1212.

The sound dampening foam 1212 may be any foam chosen with sound engineering judgment. By way of non-limiting example, sound dampening foam 1212 may be open-cell foam. The sound dampening foam 1212 may be an insulation material that absorbs multi-frequency noise, minimizes reverberation, improves acoustics, and/or may keep sound from escaping the enclosed area of the sound attenuation chamber 1201. The sound dampening foam 1212 disposed inside the sound attenuation chamber 1201 may be disposed to adequately surround the internal silencer to minimize sound. For example, small pieces of sound dampening foam 1212 may be disposed in the sound attenuation chamber 1201. In another nonlimiting example, larger pieces of sound dampening foam 1212 may be disposed in the sound attenuation chamber 1200. The pieces of sound dampening foam 1212 may be loosely packed or densely packed around the internal silencer. The sound dampening foam 1212 may partially fill or completely fill the sound attenuation chamber 1201. In another alternative embodiment, the sound dampening foam 1212 is disposed inside the sound attenuation chamber 1200 such that an operator may easily access the internal silencer for repair or replacement. In one implementation, the sound dampening foam 1212 or open-cell foam acts as a sound absorber, which may further reduce the amplitude of air exhaust noise.

With reference to FIGS. 12-18, one example implementation of the sound attenuation assembly 1200 is shown as used with a rocking piston vacuum pump 1100. The sound attenuation chamber 1201 may be operatively connected to the base 1215. In one implementation, the sound attenuation chamber 1201 may be operably connected to the rocking piston pump 1100 by way of the base 1215, which may be a spacer plate 1202. An o-ring 1203 or other seal may be interposed between the sound attenuation chamber 1201 and the spacer plate 1202. The spacer plate 1202 may be operably connected to a valve plate 1204. In one example implementation, the spacer plate 1202 may be operably connected to the valve plate 1204. The valve plate 1204 may be configured to be proximate a cylinder (previously described). The valve plate 1204 may comprise an inlet and an outlet that are in communication with the cylinder. The spacer plate 1202 may comprise an inlet chamber. An o-ring 1207 or other seal may be interposed between the spacer plate 102 and the valve plate 1204. The internal silencer 1210 may be mated directly onto or operably connected to the spacer plate 1202. A second silencer 1220 may be operably connected to the sound attenuation chamber 1201. The second silencer 1220 may be at least partially external to the sound attenuation chamber 1201 in a vacuum application. The second silencer 1220 may be operably connected to the sound attenuation chamber 1200 through one of the ports 1230 of the sound attenuation chamber 1201. In another implementation of a vacuum application, the second silencer 1220 may be operably coupled to the exhaust port 1230*b* of the sound attenuation chamber by means of an elbow 1219. The second silencer 1220 may also be a SMC ANA1-02 silencer. The combination of placing the two silencers 1210, 1220 in series may produce sound dampening of exhaust air from the pump or compressor with minimal air restriction. The sound dampening foam 1212 may add additional sound reduction. Any open ports 1230 may be closed with a port plug 1232.

Figure 16B:
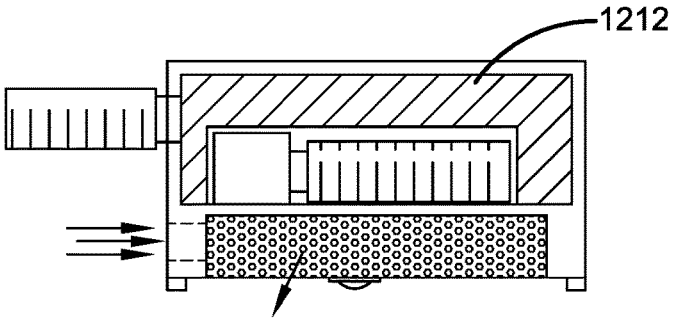
FIG. 16B is a side section view of the implementation shown in FIG. 12.
Figure 16A:
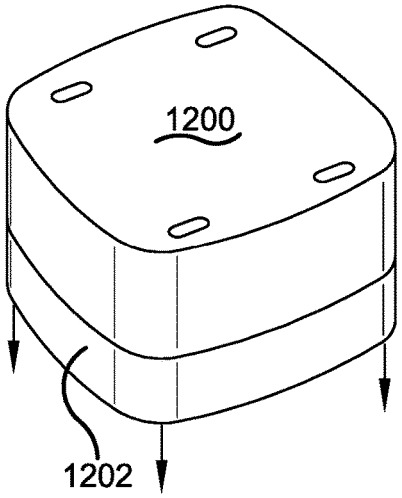
FIG. 16A is a perspective view of a sound attenuation chamber.

With references to FIGS. 16A-E, operation of the dual-head rocking piston remains the same as previously described. FIGS. 16A-E describes one example implementation of air flow for a vacuum application. The sound attenuation chamber 1200 may reduce air exhaust noise. Turning to FIGS. 16A-16E, an example of phases of air from intake to exhaust are shown. FIG. 16B illustrates intake of atmospheric air filling an air inlet chamber of the spacer plate. Intake of atmospheric air may create suction during the downstroke of a rod. The air passes through the rocking piston compressor as previously described.

After passing through the compressor, the intake atmospheric air passes into an exhaust chamber disposed in the spacer plate. This may occur with a valve limiter during the upstroke of the rod. As such, the exhaust air is routed through the valve limited and then into the exhaust chamber of the spacer plate of the sound attenuation chamber 1200.

Figure 16C:
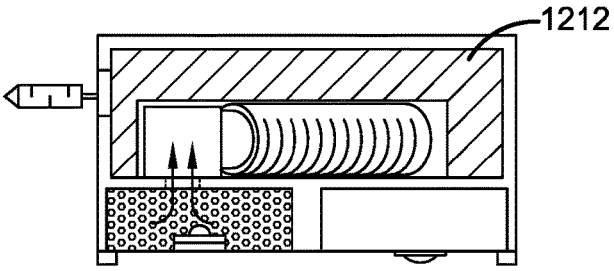
FIG. 16C is a front section view showing a first phase of the implementation shown in FIG. 12.

In another implementation, the sound attenuation chamber 1200 may process exhaust air in a plurality of phases to reduce sound. One example of such implementation may process the exhaust air in three phases. As shown in FIG. 16C, exhaust air may pass into the exhaust chamber or exhaust cavity of the spacer plate. The exhaust air may enter the first silencer 1210 at a first velocity V1. The first velocity V1 may be at a high velocity. Once the exhaust air is in the first silencer 1210, the exhaust air may be redirected into smaller streams of air that reflect off opposing walls within the silencer. It is believed that as air particles collide with each other, molecular velocity is reduced and the exhaust air is dispersed through small openings throughout the silencer at a second reduced velocity V2. Due to the reduced velocity, noise is reduced.

Figure 16D:
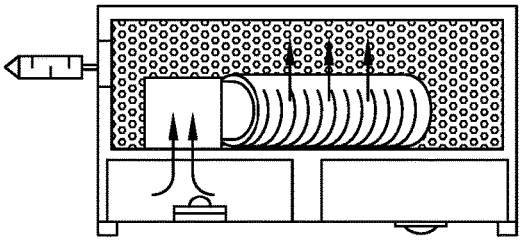
FIG. 16D is a front section view showing a second phase of the implementation shown in FIG. 12.

A second phase is shown in FIG. 16D. When the exhaust air exits the first silencer 1210, the exhaust air enters the sound attenuation chamber 1200. Sound dampening foam 1212 may be disposed inside the sound attenuation chamber 1200 as previously described. In one implementation, the sound dampening foam 1212 or open-cell foam acts as a sound absorber, which may further reduce the amplitude of air exhaust noise. By adding this volume of the sound attenuation chamber 1200 in conjunction with the sound dampening foam 1212, reflections of the noise, i.e. sound waves, weakens and causes a dulled sound effect.

Figure 16E:
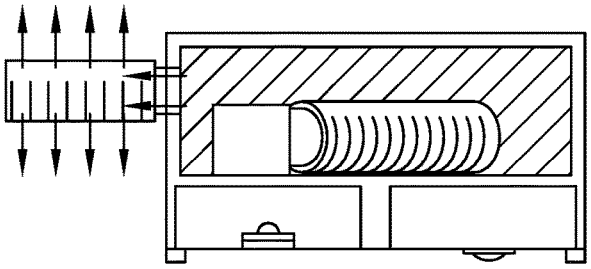
FIG. 16E is a front section view showing a third phase of the implementation shown in FIG. 12.
Figure 17:
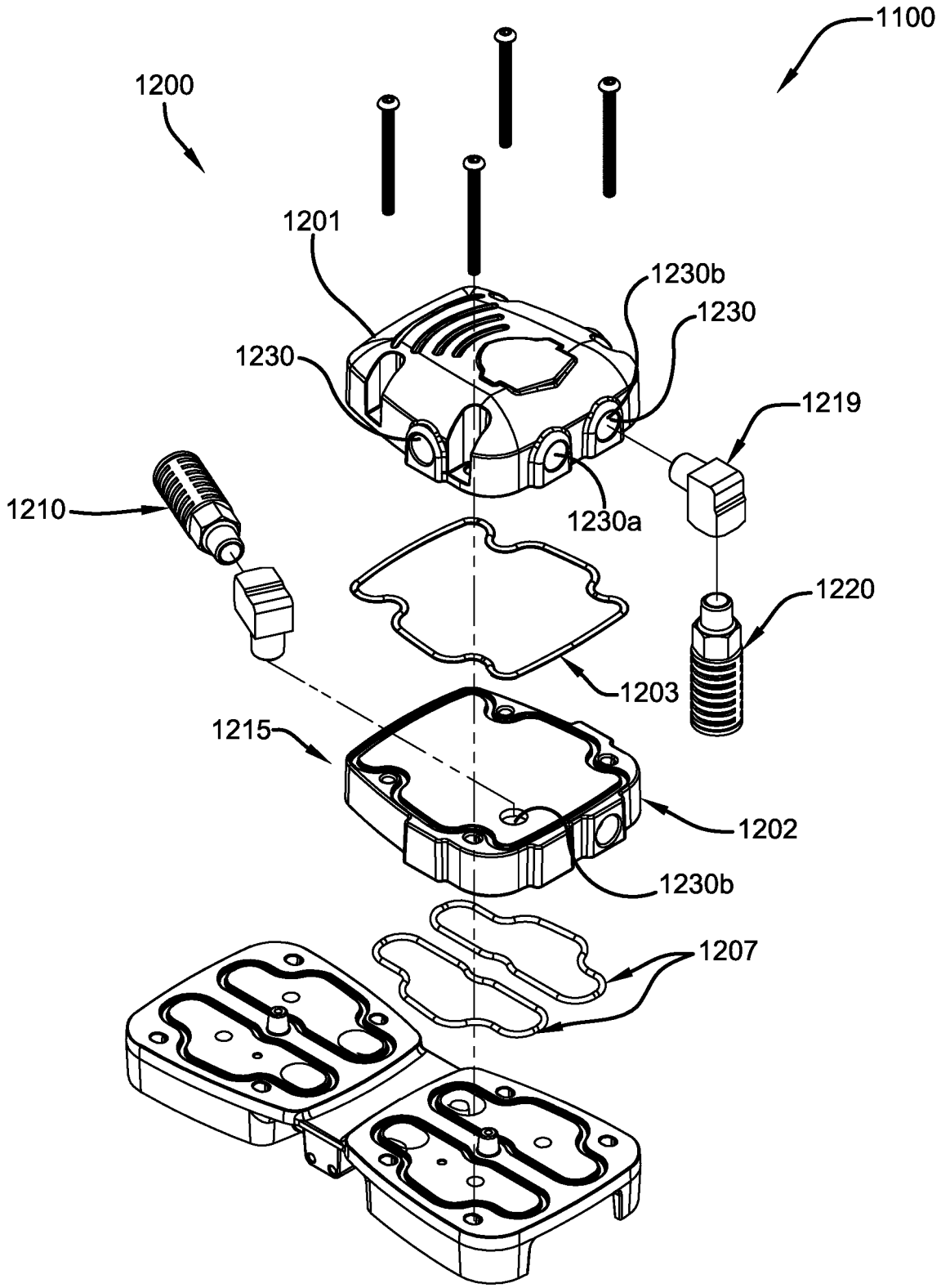
FIG. 17 is an exploded view of one example implementation of a sound attenuation chamber for a vacuum application.

A third phase is shown in FIG. 16E. After exhaust air expands and fills the sound absorbing foam filled sound attenuation chamber 1200, exhaust air is then directed to an outlet hole of the sound attenuation chamber 1200. The second silencer 1220 is operably connected to the side wall of the sound attenuation chamber 1200 by way of the outlet hole. The second silencer 1220 may be positioned in series relative to the first silencer 1210. The exhaust air may enter the second silencer 1220 at a third velocity V3. The third velocity V3 is less than velocity V2, which is less than velocity V1. Once the exhaust air is in the second silencer 1220, the exhaust air may be redirected into smaller streams of air that reflect off opposing walls within the second silencer 1220. As air particles collide with each other, molecular velocity is reduced and the exhaust air is dispersed through small openings throughout the silencer at a fourth reduced velocity V4, which is less than velocity V3. Exhaust air may exit the second silencer 1220 and be dispersed into the atmosphere.

Figure 18:
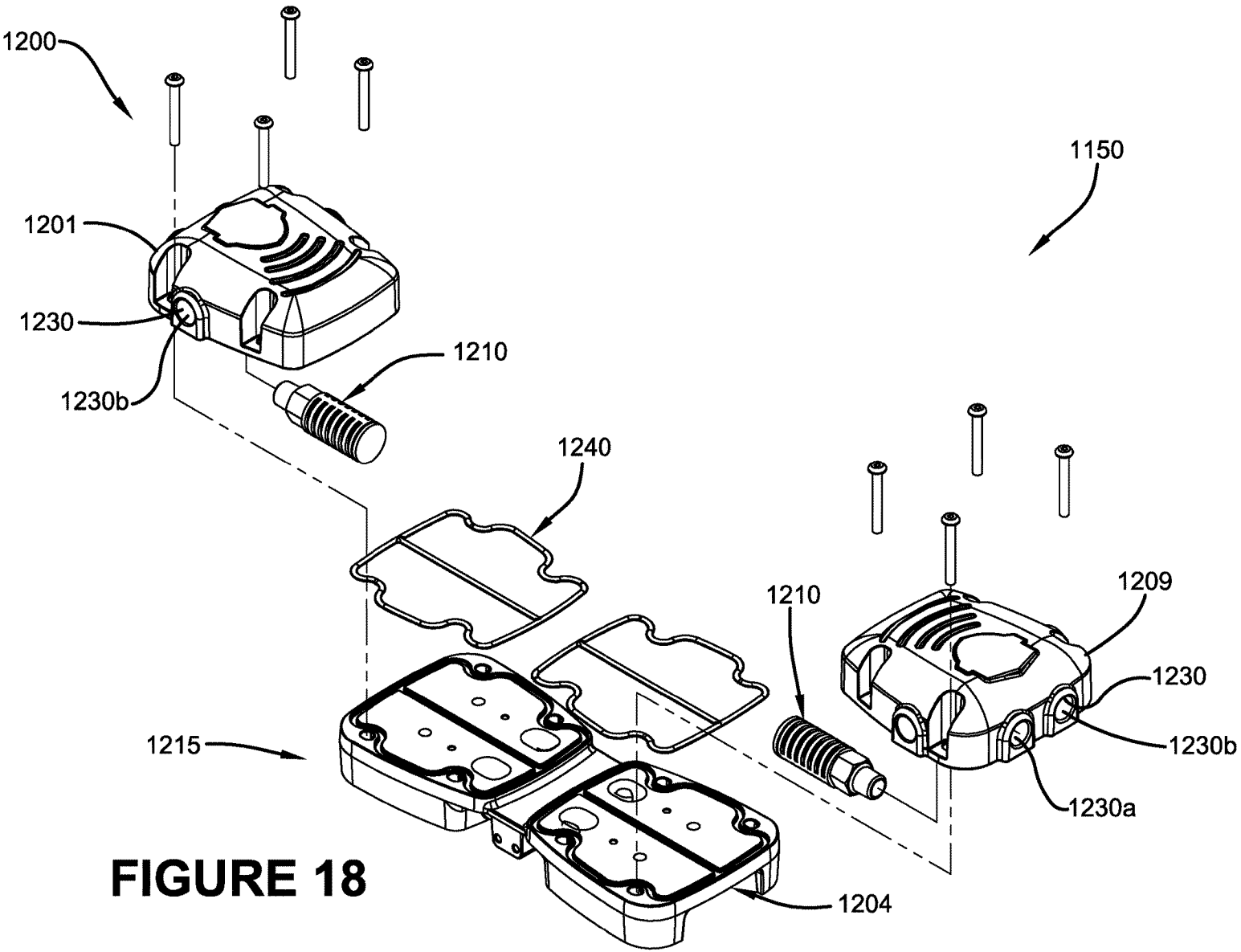
FIG. 18 is an exploded view of one example implementation of a sound attenuation chamber for a pressure application.

In another implementation, the sound attenuation assembly 1200 may be operably connected to a pressure application. In one implementation, the pressure application may be a compressor 1150 or a rocking piston compressor 1150 as shown in FIG. 18. In one implementation, the compressor or pump in a pressure application 1150 may have dual or single heads. The sound attenuation assembly 1200 may have the first sound attenuation chamber 1201. It may also comprise a second sound attenuation chamber 1209. Each sound attenuation chamber 1201, 1209 may be operably coupled to the base 1215. In the pressure application, the base 1215 may be the valve plate 1204. An o-ring 1240, o-ring gasket or other seal may be utilized to sealingly couple the sound attenuation chamber 1201 to the valve plate 1204. The valve plate 1204 may be proximate a cylinder. The valve plate 1204 may comprise an inlet and an outlet that are in communication with the cylinder. At least one sound attenuation chamber 1201 may have the first silencer 1210. The second sound attenuation chamber 1209 may also have a second silencer 1220. Optionally, additional silencers may be operably coupled to the sound attenuation ports 1230 to further reduce sound. In one example implementation of a pressure application 1150, the first silencer 1210 may be operably connected to the inlet port 1230*a* of the sound attenuation chamber 1201.

It should be understood that any number of silencers may be used in connection with the sound attenuation chamber to achieve noise reduction. For larger rocking piston compressors or pumps, two or more internal silencers may be used internally or externally given the application (vacuum or pressure).

Figure 19A:
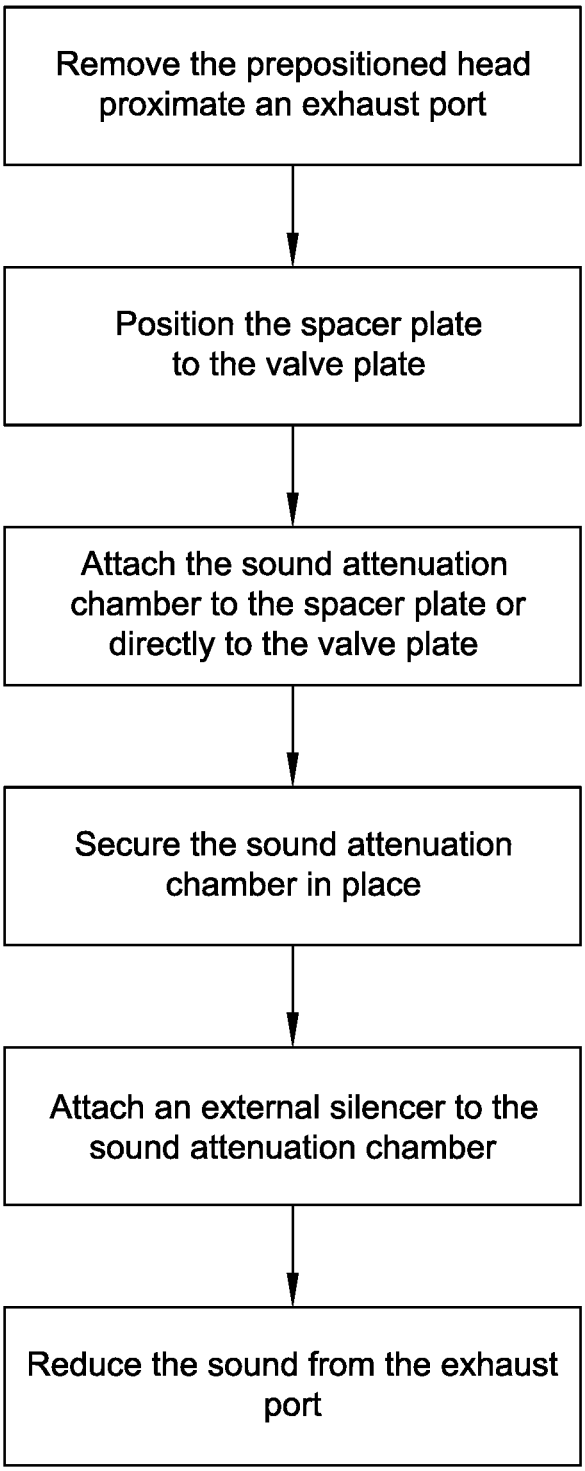
FIG. 19A is a flow chart illustrating assembly of the sound attenuation chamber for an example vacuum application.
Figure 19B:
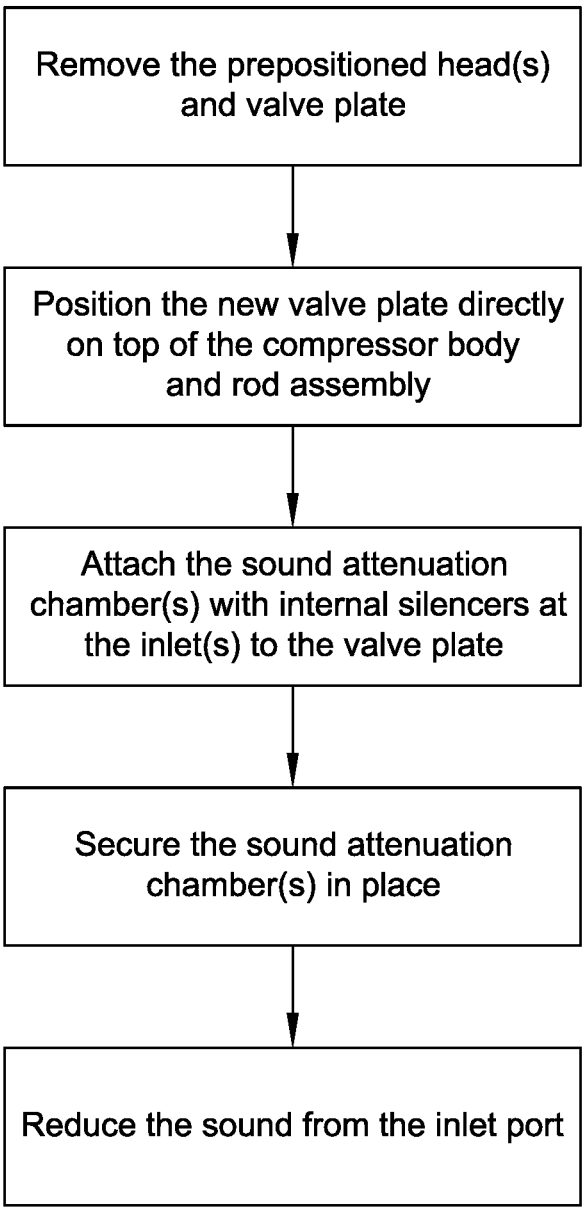
FIG. 19B is a flow chart illustrating assembly of the sound attenuation chamber for an example pressure application.

With reference to FIGS. 19A and 19B, the sound attenuation assembly 1200 may be installed onto a vacuum application 1100, such as but not limited to a rocking piston vacuum pump 1100 or a pressure application 1150, such as but not limited to the rocking piston compressor 1150 with the following steps. The propositioned head may be removed. For vacuum model applications, the spacer plate may be positioned proximate the valve plate, for example in an application with the vacuum pump. For pressure model applications, the spacer plate may not be utilized. The sound attenuation chamber may be positioned either to the spacer plate (for vacuum model applications) or the valve plate (for pressure model applications). The sound attenuation may comprise the first silencer disposed therein. For vacuum applications, the first silencer may be operably connected to the exhaust or outlet port 1230*b* of the sound attenuation chamber. For pressure applications, the first silencer may be operably connected to the inlet port 1230*a* of the sound attenuation chamber. The second silencer may be operably connected to one of the exhaust ports of the sound attenuation chamber in a vacuum application. The sound is then reduced during operation of the rocking piston vacuum pump or the rocking piston compressor.

Figure 20:
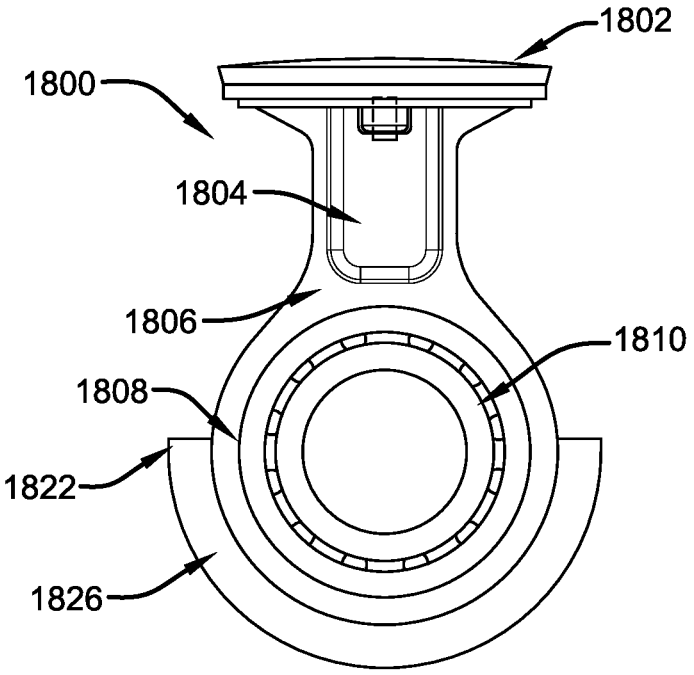
FIG. 20 is a front view of a rod assembly.
Figure 21:
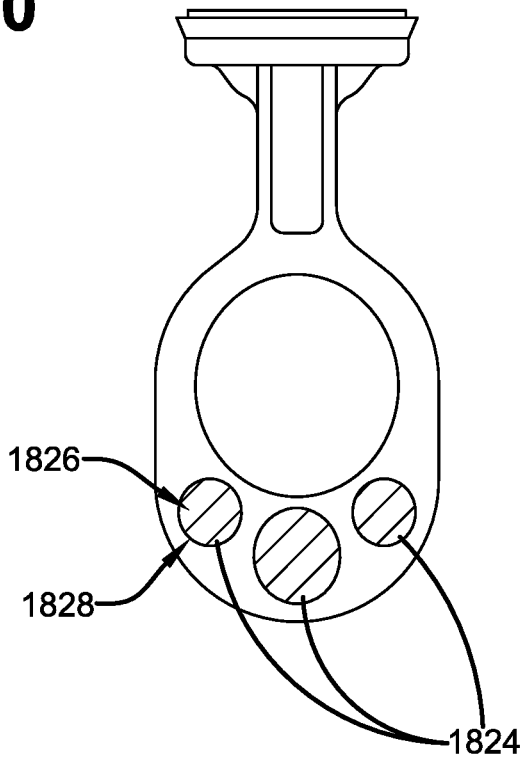
FIG. 21 is another front view of a rod assembly.

With reference to FIGS. 20 and 21, another implementation of a rocking piston compressor is illustrated to reduce vibration. The compressor may have a rod assembly 1800 which may be operably connected to the draft shaft 54, which has been previously described. The rod assembly 1800 may comprise a piston head 1802, a rod 1804, and a rod assembly body 1806. The rod assembly body 1806 may have a bore 1808 for positioning a bearing 1810 therein. The rod assembly 1800 has a center of mass CM. A counterbalance weight 1820 may be disposed on the rod assembly 1800 to move the center of mass from the center of the rod assembly 1800 to a center of the bearing 1810 or bearing bore 1808. Vibration transmission is minimized from the rod and shaft. It is believed that the exerting forces will be reduced from about 11 Newtons to about 0 Newtons. In one nonlimiting implementation, tungsten may be used to provide the correct amount of mass due to possible space constraints within the compressor.

In one nonlimiting example, the counter balance weight 1820 may be positioned on a lower portion of the rod assembly body 1806. In one implementation, the counterbalance weight 1820 may be positioned on an exterior surface 1807 of the rod assembly body 1806. In another implementation, the counterbalance weight 1820 may have an edge 1822, and the edge 1822 may be disposed concentric with the bearing bore 1808 or below the center of the bearing 1810. In another implementation, holes 1824 may be bored in the bottom portion of the rod assembly body 1806, where the holes 1824 may be filled with dense metal 1826, such as, but not limited to tungsten 1828. By moving the center of mass to be coincident with the center of the bearing or the bearing bore, vibration may be minimized.

Within applications, such as but not limited to medical and dental system applications, that require little to no vibration, particularly when mounted to a cabinet system. Reducing compresor vibration may also contribute to a longer life cycle of the compressor components and the compressor itself. By positioning the rod assembly's center of mass to be substantially concentric with the center of the bearing bore, dynamic balance becomes more stable when the eccentric is included, resulting in minimizing dynamic forces. In minimizing vibration of the compressor through rod assembly alterations, the compressor will experience less wear and tear.

Finally, the disclose compressors are capable of assuming multiple configurations, including low profile configurations and configurations which may permit the use of a larger motor. The flow direction of the compressors may be easily reversed.

The word "exemplary" is used herein to mean serving as an example, instance or illustration. Any aspect or design described herein as "exemplary" is not necessarily to be construed as advantageous over other aspects or designs. Rather, use of the word exemplary is intended to present concepts in a concrete fashion. As used in this application, the term "or" is intended to mean an inclusive "or" rather than an exclusive "or." That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. Further, at least one of A and B and/or the like generally means A or B or both A and B. In addition, the articles "a" and "an" as used in this application and the appended claims may generally be construed to mean "one or more" unless specified otherwise or clear from context to be directed to a singular form.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims. Of course, those skilled in the art will recognize many modifications may be made to this configuration without departing from the scope or spirit of the claimed subject matter.

Also, although the disclosure has been shown and described with respect to one or more implementations, equivalent alterations and modifications will occur to others skilled in the art based upon a reading and understanding of this specification and the annexed drawings. The disclosure includes all such modifications and alterations and is limited only by the scope of the following claims. In particular regard to the various functions performed by the above described components (e.g., elements, resources, etc.), the terms used to describe such components are intended to correspond, unless otherwise indicated, to any component which performs the specified function of the described component (e.g., that is functionally equivalent), even though not structurally equivalent to the disclosed structure which performs the function in the herein illustrated exemplary implementations of the disclosure.

In addition, while a particular feature of the disclosure may have been disclosed with respect to only one of several implementations, such feature may be combined with one or more other features of the other implementations as may be desired and advantageous for any given or particular application. Furthermore, to the extent that the terms "includes," "having," "has," "with," or variants thereof are used in either the detailed description or the claims, such terms are The implementations have been described, hereinabove. It will be apparent to those skilled in the art that the above methods and apparatuses may incorporate changes and modifications without departing from the general scope of this invention. It is intended to include all such modifications and alterations in so far as they come within the scope of the appended claims or the equivalents thereof.

What is claimed is:

1. A sound attenuation assembly for a pressure application for a rocking piston compressor or rocking piston pump, the rocking piston compressor or rocking piston pump, comprising:

a first rocking piston assembly operably connected to a first cylinder;

a second rocking piston assembly operably connected to a second cylinder;

a valve plate body comprising a first valve plate coupled to a second valve plate by a crossover passageway, wherein the first valve plate proximate the first cylinder, and wherein the second valve plate proximate the second cylinder;

a first head arranged over the first valve plate and comprising a first intake port and a first exhaust port;

a second head arranged over the second valve plate comprising a second intake port and a second exhaust port;

the sound attenuation chamber assembly, comprising:

a first sound attenuation chamber operably connected to and arranged proximate the first valve plate, the first sound attenuation chamber disposed over the first head;

a second sound attenuation chamber operably connected to and arranged proximate the second valve plate, the second sound attenuation chamber disposed over the second head; and, a first silencer operably disposed in the first sound attenuation chamber and a second silencer disposed in the second sound attenuation chamber, wherein the first and second sound attenuation chambers and the first and second silencers are configured to reduce sound for the rocking piston compressor or the rocking piston pump, wherein the first silencer and the second silencer receive air in parallel at the respective intake ports in the pressure application.

2. The sound attenuation assembly of claim 1, further comprising at least one additional silencer disposed in the first attenuation chamber.

3. The sound attenuation assembly of claim 1, wherein the first sound attenuation chamber is selectably removable from the first valve plate and the second sound attenuation chamber is selectably removable from the second valve plate.

4. The sound attenuation-assembly of claim 1, further comprising foam, the foam at least partially engulfing the first silencer.

5. The sound attenuation assembly of claim 1, further comprising at least one additional silencer disposed in the second sound attenuation chamber.

6. The sound attenuation assembly of claim 1, wherein the first sound attenuation chamber is sealingly coupled to the first valve plate with an o-ring or gasket and the second sound attenuation chamber is sealingly coupled to the second valve plate with an o-ring or gasket.

7. A sound attenuation assembly for a rocking piston pump or a rocking piston compressor, comprising:

a valve plate proximate a cylinder, the valve plate comprising an inlet and an outlet that are in communication with the cylinder;

a sound attenuation chamber operably connected to the valve plate, the sound attenuation chamber having an inlet port and an outlet port;

a first silencer operably connected to the sound attenuation chamber, wherein the first silencer is operably connected to the inlet port for a pressure application or the first silencer is operably connected to the outlet port for a vacuum application;

a spacer plate interposed between the sound attenuation chamber and the valve plate, wherein the spacer plate defines a chamber for air and is arranged between the sound attenuation chamber and the valve plate; and an additional valve plate proximate an additional cylinder and coupled to the valve plate by a crossover passageway;

the rocking piston compressor or the rocking piston pump, comprising:

a first rocking piston operably connected to the cylinder; and a second rocking piston operably connected to the additional cylinder; and a head arranged over the additional valve plate and comprising a first intake port and a first exhaust port.

8. The sound attenuation assembly of claim 7, further comprising a second silencer mated onto and disposed external to the spacer plate, wherein the second silencer is in series with the first silencer.

9. The sound attenuation assembly of claim 7, further comprising sound dampening foam at least partially engulfing the first silencer and at least partially filling the sound attenuation chamber.

10. The sound attenuation assembly of claim 7, wherein the spacer plate has outer sidewalls arranged directly over outer sidewalls of the valve plate, wherein the outer sidewalls of the spacer plate are arranged directly below outer sidewalls of the sound attenuation chamber, and wherein the spacer plate is sealed to the valve plate and is sealed to the sound attenuation chamber.

11. A method for reducing sound in a rocking piston vacuum pump or rocking piston compressor, comprising the steps of:

removing a prepositioned head from a valve plate;

positioning a spacer plate over the valve plate after removing the prepositioned head;

positioning a sound attenuation chamber to the spacer plate after positioning the spacer plate, the sound attenuation chamber comprising an inlet port and an outlet port;

operably connecting a first silencer to the inlet port for a pressure application or operably the first silencer to the outlet port for a vacuum application; and reducing sound during operation of the rocking piston vacuum pump or the rocking piston compressor.

12. The method of claim 11, further comprising the step of operably connecting a second silencer externally to the sound attenuation chamber and in series with the first silencer.

13. The method of claim 11, the valve plate configured to be proximate a cylinder, the valve plate including an inlet and an outlet that are in communication with the cylinder.

14. The method of claim 11, wherein the first silencer is mated directly onto the spacer plate.

15. A sound attenuation assembly for a rocking piston pump or a rocking piston compressor, comprising: a valve plate proximate a cylinder, the valve plate comprising an inlet and an outlet that are in communication with the cylinder; a sound attenuation chamber operably connected to the valve plate, the sound attenuation chamber having an inlet port and an outlet port; a first silencer operably connected to the sound attenuation chamber, wherein the first silencer is operably connected to the inlet port for a pressure application or the first silencer is operably connected to the outlet port for a vacuum application; a spacer plate interposed between the sound attenuation chamber and the valve plate, wherein the spacer plate defines a chamber for air and is arranged between the sound attenuation chamber and the valve plate; an additional valve plate proximate an additional cylinder and coupled to the valve plate by a crossover passageway, and a head arranged over the additional valve plate and comprising a first intake port and a first exhaust port, wherein the sound attenuation chamber is arranged above a topmost surface of the head.

* * * * *